US012760503B2

(12) United States Patent
Kwacz et al.

(10) Patent No.: US 12,760,503 B2
(45) Date of Patent: Oct. 13, 2026

(54) OBJECT SENSING AND CUSTOMIZED DISPENSING

(71) Applicant: Kohler Co., Kohler, WI (US)

(72) Inventors: Jason M. Kwacz, Kohler, WI (US); Yachna Garg, Gurgaon (IN)

(73) Assignee: Kohler Co., Kohler, WI (US)

( * ) Notice: Subject to any disclaimer, the term of this patent is extended or adjusted under 35 U.S.C. 154(b) by 37 days.

(21) Appl. No.: 18/909,675

(22) Filed: Oct. 8, 2024

(65) Prior Publication Data

US 2025/0137242 A1 May 1, 2025

Related U.S. Application Data

(60) Provisional application No. 63/595,106, filed on Nov. 1, 2023.

(51) Int. Cl.
*E03C 1/05* (2006.01)

(52) U.S. Cl.
CPC ..... *E03C 1/057* (2013.01); *E03C 2201/40* (2013.01)

(58) Field of Classification Search
CPC ..... E03C 1/046; E03C 1/057; E03C 1/055; E03C 2201/45; E03C 2201/40; Y10T 137/9464; Y10T 137/87249; G06K 9/6267; G06K 9/6201; G06K 9/6227; G06V 20/10; G06N 3/08; F16K 37/005; F16K 37/0058
See application file for complete search history.

(56) References Cited

U.S. PATENT DOCUMENTS

| | | | | |
|---|---|---|---|---|
| 2,778,800 | A * | 1/1957 | Sheahan | C02F 1/78 137/637.1 |
| 4,446,896 | A | 5/1984 | Campagna | |
| 4,559,979 | A | 12/1985 | Koblasz | |
| 4,572,253 | A | 2/1986 | Farmer | |
| 4,917,155 | A | 4/1990 | Koblasz | |
| 5,491,333 | A | 2/1996 | Skell | |
| 5,566,702 | A * | 10/1996 | Philipp | E03C 1/057 137/1 |
| 5,868,311 | A * | 2/1999 | Cretu-Petra | G05D 23/1393 236/12.12 |
| 6,521,194 | B2 * | 2/2003 | Yeh | C02F 1/78 210/760 |
| 6,789,585 | B1 | 9/2004 | Janke | |
| 6,973,937 | B1 * | 12/2005 | Yang | E03C 1/023 137/119.05 |

(Continued)

FOREIGN PATENT DOCUMENTS

| | | | |
|---|---|---|---|
| CN | 105231468 | A | 1/2016 |
| IN | 202241076451 | A | 1/2023 |

(Continued)

*Primary Examiner* — Matthew W Jellett
(74) *Attorney, Agent, or Firm* — Lempia Summerfield Katz LLC

(57) ABSTRACT

A system for controlling a faucet includes a faucet having a spout, the spout configured to direct a fluid into a sink, an image sensor configured to collect image data, and a processor configured to analyze the image date. The processor may analyze the image data and assign a classification to an object included in the image data, select a flow attribute based on the assigned classification, and cause the faucet to direct a flow of fluid having the selected flow attribute into the sink.

19 Claims, 10 Drawing Sheets

(56) References Cited

U.S. PATENT DOCUMENTS 7,070,125 B2 * 7/2006 Williams ..... E03C 1/0404 239/443
7,171,993 B2 2/2007 Bethuy
7,182,858 B2 * 2/2007 Brown ..... B01D 61/20 137/802
7,228,874 B2 * 6/2007 Bolderheij ..... E03C 1/055 222/145.5
7,353,850 B2 4/2008 Greiwe
7,488,419 B1 * 2/2009 Wang ..... A61L 2/183 261/DIG. 42
8,151,596 B2 4/2012 Richmond
8,162,236 B2 * 4/2012 Rodenbeck ..... G05D 23/1353 239/447
8,322,384 B2 12/2012 Ashrafzadeh
8,327,889 B2 12/2012 Ashrafzadeh
8,353,321 B2 1/2013 Agam
8,695,646 B2 4/2014 Agam
8,714,210 B2 5/2014 Ashrafzadeh
8,813,794 B2 8/2014 Ashrafzadeh
9,032,565 B2 * 5/2015 Loeck ..... E03C 1/057 251/129.04
9,057,556 B2 6/2015 Ashrafzadeh
9,085,453 B2 7/2015 Mcmahan
9,126,818 B2 9/2015 Chase
9,212,040 B2 12/2015 Segiet
9,499,384 B2 11/2016 Chase
9,517,441 B2 12/2016 Jablonski
9,557,097 B2 1/2017 Mcmahan
9,739,517 B2 8/2017 Root
9,809,439 B2 11/2017 Falco, III
9,828,228 B2 11/2017 Chase
9,890,029 B2 2/2018 Comsa
9,908,768 B2 3/2018 Ashrafzadeh
10,053,354 B2 8/2018 Rosenlund
10,233,069 B2 3/2019 Chase
10,233,070 B2 3/2019 Comsa
10,233,621 B2 * 3/2019 Park ..... E03C 1/055
10,239,742 B2 3/2019 Dresser
10,401,080 B2 9/2019 Root
10,519,025 B2 12/2019 Sakthivel
10,689,241 B2 6/2020 Dresser
10,752,487 B2 8/2020 Rosenlund
10,759,644 B2 9/2020 Lim
10,767,270 B2 * 9/2020 Jonte ..... C25B 11/091
10,793,415 B2 10/2020 Choi
10,829,362 B2 11/2020 Chernov
10,837,698 B2 11/2020 Choy
10,850,964 B2 12/2020 Bhaskar
10,850,967 B2 12/2020 Chase
10,853,701 B2 12/2020 Lelkes
10,858,235 B2 12/2020 Jung
10,883,730 B2 * 1/2021 Wang ..... G06V 40/28
10,889,484 B2 1/2021 Subramanya
10,894,707 B2 1/2021 Pohl
10,926,993 B2 2/2021 Lynch
10,947,104 B2 3/2021 Chernov
10,988,366 B2 4/2021 Garcia
11,117,793 B1 9/2021 Khan
11,117,794 B2 9/2021 Candido De Lima Junior
11,136,232 B2 10/2021 Park
11,144,792 B2 10/2021 Jin
11,154,034 B2 10/2021 Youn
11,186,475 B2 11/2021 Kim
11,208,316 B2 12/2021 Dresser
11,220,754 B2 * 1/2022 Jonte ..... C25B 1/13
11,235,965 B2 2/2022 Chase
11,274,028 B2 3/2022 Defazio
11,339,047 B2 5/2022 Chernov
11,365,109 B2 6/2022 Park
11,390,515 B2 7/2022 Lynch
11,440,785 B2 9/2022 Schultz
11,453,583 B2 9/2022 Garcia
11,458,214 B2 * 10/2022 Rodenbeck ..... A61L 2/24
11,472,687 B2 10/2022 Mullenaux
11,472,693 B2 10/2022 Bendig
11,505,444 B1 11/2022 Root
11,511,984 B2 11/2022 Moskowitz
11,511,985 B2 11/2022 Juratovac
11,518,670 B2 12/2022 Kim
11,553,811 B2 1/2023 Tuchrelo
11,565,931 B2 1/2023 Neubauer
11,781,298 B2 * 10/2023 Obrist ..... G06T 7/70 4/623
11,859,375 B2 * 1/2024 Loeck ..... E03C 1/057
12,116,258 B2 * 10/2024 Wu ..... E03C 1/046
12,123,181 B1 * 10/2024 Chen ..... E03C 1/057
2006/0231782 A1 * 10/2006 Iott ..... E03C 1/057 251/129.04
2007/0267098 A1 11/2007 Ozanne
2008/0105331 A1 5/2008 You
2008/0190514 A1 8/2008 Lee
2011/0284431 A1 * 11/2011 Ito ..... B07C 5/366 209/552
2012/0266983 A1 * 10/2012 Tsai ..... E03C 1/046 210/198.1
2014/0251795 A1 * 9/2014 Chen ..... B01J 27/24 204/252
2014/0352799 A1 * 12/2014 Rosko ..... C02F 1/78 137/237
2017/0135519 A1 5/2017 Deng
2019/0162426 A1 * 5/2019 Wang ..... E03C 1/057
2020/0307983 A1 10/2020 Checchinato
2021/0025648 A1 1/2021 Choy
2021/0045572 A1 2/2021 Ninomiya
2021/0078848 A1 * 3/2021 Nocchi ..... G06F 18/2413
2021/0094816 A1 4/2021 Tokunaga
2021/0347628 A1 11/2021 Bendig
2021/0380393 A1 12/2021 Schucker
2021/0387845 A1 12/2021 Taylor
2022/0002137 A1 1/2022 Carone
2022/0017351 A1 1/2022 Khan
2022/0017354 A1 1/2022 Cahill
2022/0024747 A1 1/2022 Clüsserath
2022/0048754 A1 2/2022 Schnacke
2022/0081277 A1 3/2022 Newton
2022/0185650 A1 6/2022 Yun
2022/0212913 A1 7/2022 Defazio
2022/0219963 A1 7/2022 Lee
2022/0219964 A1 7/2022 Lee
2022/0259028 A1 8/2022 Mullenaux
2022/0259033 A1 8/2022 Mullenaux
2023/0002210 A1 1/2023 Bendig

FOREIGN PATENT DOCUMENTS

JP 2001270598 A 10/2001
JP 2004079884 A 3/2004
JP 2007022560 A 2/2007
JP 2021066504 A 4/2021
KR 100755142 B1 9/2007
KR 20170104811 A 9/2017
KR 20190099186 A 8/2019
WO 2016183631 A1 11/2016
WO 2020047845 A1 3/2020
WO 2020185325 A1 9/2020
WO 2021007043 A1 1/2021
WO 2021032181 A1 2/2021
WO 2021040222 A1 3/2021
WO 2021151157 A1 8/2021
WO 2021157227 A1 8/2021
WO 2021177819 A1 9/2021
WO 2021185588 A1 9/2021
WO 2021205146 A1 10/2021
WO 2021231516 A1 11/2021
WO 2021247830 A1 12/2021
WO 2021257215 A1 12/2021
WO 2021257986 A1 12/2021
WO 2022015451 A1 1/2022
WO 2022027022 A1 2/2022
WO 2022107062 A1 5/2022
WO 2022136528 A1 6/2022
WO 2022136587 A1 6/2022

(56) References Cited

FOREIGN PATENT DOCUMENTS

| | | | |
|---|---|---|---|
| WO | 2022212592 | A1 | 10/2022 |
| WO | 2022241487 | A1 | 11/2022 |
| WO | 2022255922 | A1 | 12/2022 |
| WO | 2023272356 | A1 | 1/2023 |

* cited by examiner

OBJECT SENSING AND CUSTOMIZED DISPENSING

CROSS-REFERENCE TO RELATED APPLICATION

This application claims priority benefit of Provisional Application No. 63/595,106 filed on Nov. 1, 2023, which is hereby incorporated by reference in its entirety.

FIELD

The present disclosure relates generally to faucets. More specifically, the present disclosure relates to faucets including object sensing and automatic dispensing features.

BACKGROUND

Generally, faucets provide or dispense fluids (e.g., water) to a sink or basin. Many faucets are manually controlled, for example, by rotating one or more handle(s) proximate to the faucet. Faucets are versatile fixtures used to perform many distinct functions, for example, faucets are used for dishwashing, food preparation, hand washing, and the like. Each of these applications may require different water temperatures, volumes of water, and the like. Manual control of these characteristics is burdensome, inconveniencing users.

BRIEF DESCRIPTION OF THE DRAWINGS

Objects, features, and advantages of the present disclosure should become more apparent upon reading the following detailed description in conjunction with the drawing figures, in which.

Figure 1:
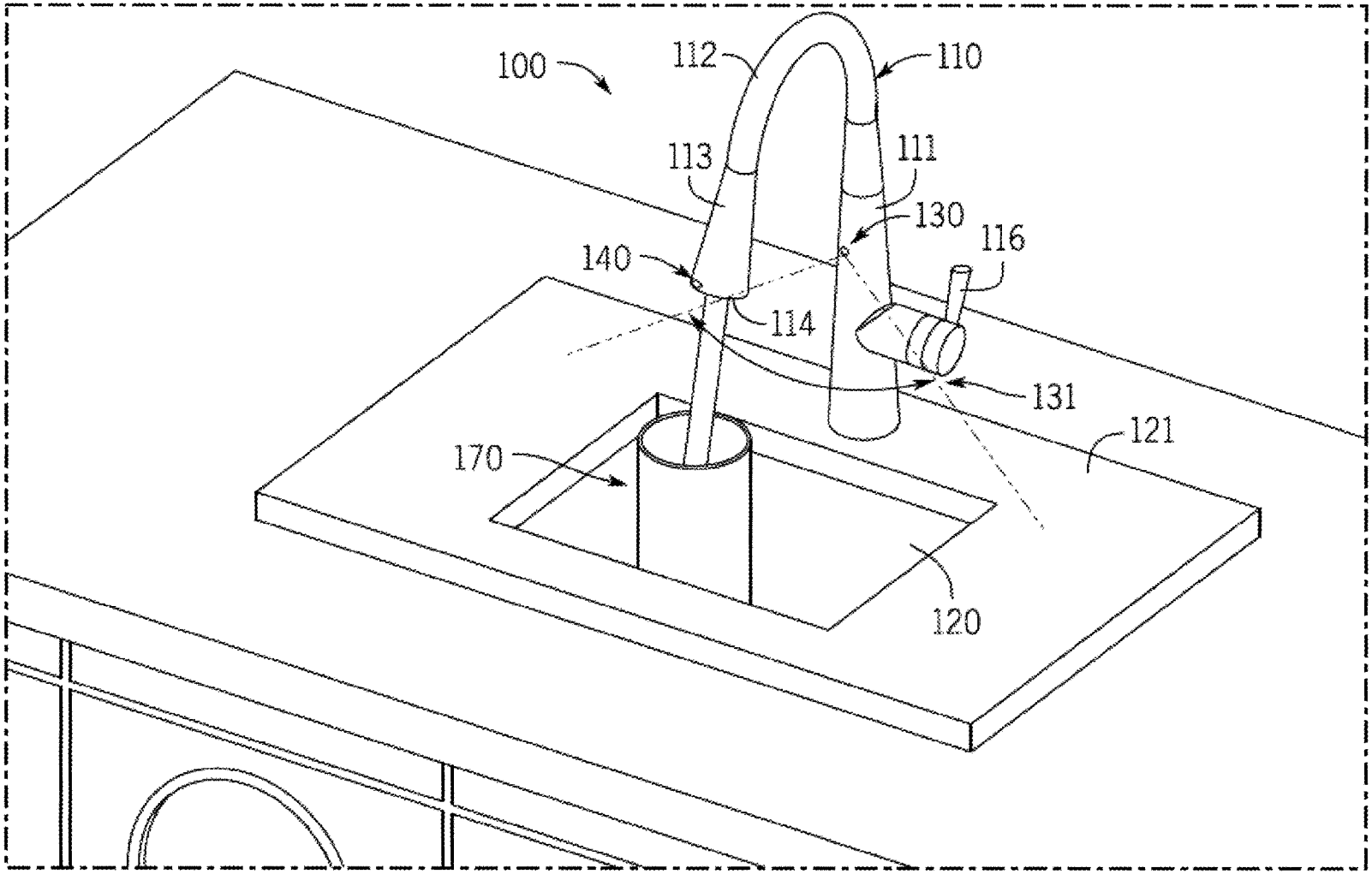
FIG. 1 illustrates a faucet in accordance with one example of the present disclosure.

The figures illustrate certain examples of the present disclosure in detail. It should be understood that the present disclosure is not limited to the details and methodology set forth in the detailed description or illustrated in the figures. It should be understood that the terminology used herein is for the purposes of description only and should not be regarded as limiting.

DETAILED DESCRIPTION

Described herein are devices, systems, and methods for controlling one or more characteristics of a flow of water dispensed from a faucet based on an object or a type of object disposed below the faucet. The faucet may control a type of water dispensed, a flow type of the water dispensed, a duration for which the water is dispensed, a temperature of water dispensed, a flow rate of the water dispensed, and the like. Specifically, the devices, systems, and methods described herein may control a flow attribute of water directed into a sink (e.g., dispensed), the flow attribute comprising a type of fluid dispensed and/or a flow type of fluid dispensed.

Generally, it may be beneficial to use different water types and/or dispense water having different flow types based on the object disposed below the faucet and/or the application for which the water is being used. For example, when a drinking glass is disposed below the faucet, the faucet may dispense filtered water having a laminar flow type, filling the glass with drinking water. In another example, when a dish is disposed below the faucet, the faucet may dispense tap water having a sweeping flow, for cleaning the dish. In some examples, a flow rate of the water dispensed when a dish is disposed below the faucet may vary based on a level of cleanliness or contamination of the dish. In yet another example, when a fruit and/or a vegetable is placed below the faucet, the faucet may dispense ozone water, electro chlorinated water, or electrolyzed water having a soft spray flow type for cleaning the fruits and vegetables.

In some examples, in addition to varying a type of water dispensed and/or a flow type of the water dispensed, the faucet may control a flow rate, a duration during which water is dispensed, and/or a temperature of water dispensed. For example, when a drinking glass is disposed below the faucet, the faucet may dispense cold water having a controlled flow rate for a controlled duration required to fill the glass. In another example, when a dish is disposed below the faucet, the faucet may dispense hot water for cleaning the dish. Similarly, when a clean dish or glass is disposed below the faucet, the faucet may dispense cold water having a flow rate and/or duration required to fill the glass, and when a dirty dish or glass is disposed below the faucet, the faucet may dispense hot water for cleaning the dish.

Referring generally to the various devices, systems, and methods described herein, a soft spray may be dispensed for cleaning fruits and/or vegetables, a sweeping flow may be used for cleaning dishes, and a laminar flow may be used for filling objects with water. Additionally, in some examples, the faucet may be configured to sense or detect and classify a cleanliness of any of the above identified objects (e.g., fruits, vegetables, dishes) and vary a flow rate of water dispensed based on the cleanliness (e.g., cleanliness classification or ranking) of the object. As used herein, the term dish includes any object or utensil used for food preparation and/or consumption, for example, pots, pans, plates, bowls, silverware, cooking spoons, spatulas, and the like.

Referring generally to the figures, the devices and systems described herein may include a range sensor (e.g., an ultrasonic sensor, a radar sensor) and/or an image sensor or camera configured to sense an object disposed below the faucet. For example, a field of view of the range sensor and image sensor may be directed toward a sink or basin disposed below the faucet. Specifically, the ranging sensor may be configured to detect the presence of an object below the faucet and/or a distance between the faucet and the object disposed below the faucet. The imaging sensor may be configured to capture images of an object below the faucet, for example, as a user places or holds the object below the faucet. In some examples, the image sensor may capture an image in response to the range sensor detecting an object below the faucet. Objects placed below the faucet may include, for example, a dish, a glass, a bottle, fruits, hands, a toothbrush, and the like.

A faucet control system may receive the image or image data from the camera. Specifically, in some examples, a processor may receive the image from the camera. The faucet control system or processor may process the image to detect and classify the object included in the image. The faucet control system may cause the faucet (e.g., a spout of the faucet) to dispense a flow of fluid with characteristics (e.g., a water type, flow type, temperature, flow rate, etc.) which correspond to the classification of the object in the image. Accordingly, in the devices, systems, and methods described herein, fluid flow characteristics including a type of water dispensed and a flow type (e.g., soft spray, sweeping flow, laminar flow) may be dynamically changed and controlled according to the object or objects disposed below the faucet. Specifically, a flow attribute comprising one of a fluid type and a fluid flow type may be dynamically changed (e.g., selected) based on an object or objects disposed below the faucet. Accordingly, the faucet may be automatically controlled to be adapted to different uses based on the object or type of object positioned below the faucet.

Referring generally to FIGS. 1-4, faucets 100, 200, 300, 400 according to examples of the present disclosure are illustrated. Each of the faucets 100, 200, 300, 400 may be used or incorporated in various different environments, for example, each of the faucets 100, 200, 300, 400 may be included in a kitchen, bathroom, food processing plants, and the like. As illustrated, each of the faucets 100, 200, 300, 400 may include a spout 110 configured to direct a flow of fluid (e.g., water) into a sink 120. Each of the faucets 100, 200, 300, 400 may be mounted directly to the sink 120 or to a surface 121 (e.g., countertop) adjacent to the sink 120. In some examples, the spout 110 may extend upward (e.g., from the sink 120, from the surface 121) in an inverted J-shaped manner. Specifically, the spout 110 may include an extension portion 111 extending upward (e.g., vertically away from the sink 120), an arched portion 112, and an end portion 113 extending downward (e.g., vertically toward the sink 120). The arched portion 112 may connect the extension portion 111 and the end portion 113. Additionally, the end portion 113 may include an opening 114 facing the sink 120 and configured to dispense or convey fluid into the sink 120. The size, shape, and configuration of the faucets 100, 200, 300, 400 may differ from those shown in the accompanying drawings and all such variations are within the scope of the present disclosure.

In operation, fluid (e.g., water) flows into the faucet 100, 200, 300, 400 from one or more water sources, up the extension portion 111 of the spout 110, through the arched portion 112, and out of the opening 114 in the end portion 113 into the sink 120. In some examples, a user may manually turn the faucet 100, 200, 300, 400 on or off via rotation or manipulation of one or more handles 116 coupled to or located proximate to the faucet 100, 200, 300, 400. Additionally, a temperature and/or flow rate of fluid dispensed from the faucet may be changed by manipulating the one or more handles 116. In some touchless applications, a user turns on the faucet 100, 200, 300, 400 by positioning their hands or an object beneath the spout 110. A sensor detects the object 170 (e.g., a user's hands) below the spout 110 and activates a valve (e.g., solenoid valve) to induce flow into the sink 120. In such applications, fluid flow is binary (e.g., "on" and "off" based on the presence or absence of an object 170 below the spout 110). According to the examples of the present disclosure described herein, a fluid type and/or a fluid flow type (i.e., a flow attribute) are adapted (e.g., selected, determined) based on a type of object 170 and or characteristics (e.g., cleanliness) of the object placed beneath the spout 110.

Each of the faucets 100, 200, 300, 400 described herein may include one or more sensors. Specifically, each of the faucets 100, 200, 300, 400 may include an image sensor 130. In some examples, each of the faucets 100, 200, 300, 400 may further include a range sensor 140. The image sensor 130 and/or the range sensor 140 are mounted to the faucet 100, 200, 300, 400 so as to have a field of view that includes the sink 120. In some examples, the image sensor 130 and the range sensor 140 may be mounted so as to have a field of view that includes a portion of the surface 121 (e.g., countertop) adjacent to the sink 120. Specifically, in some examples, the image sensor 130 may have a field of view 131. Generally, the image sensor 130 and the range sensor 140 may face outward from the faucet 100, 200, 300, 400 toward the sink 120.

Figure 2:
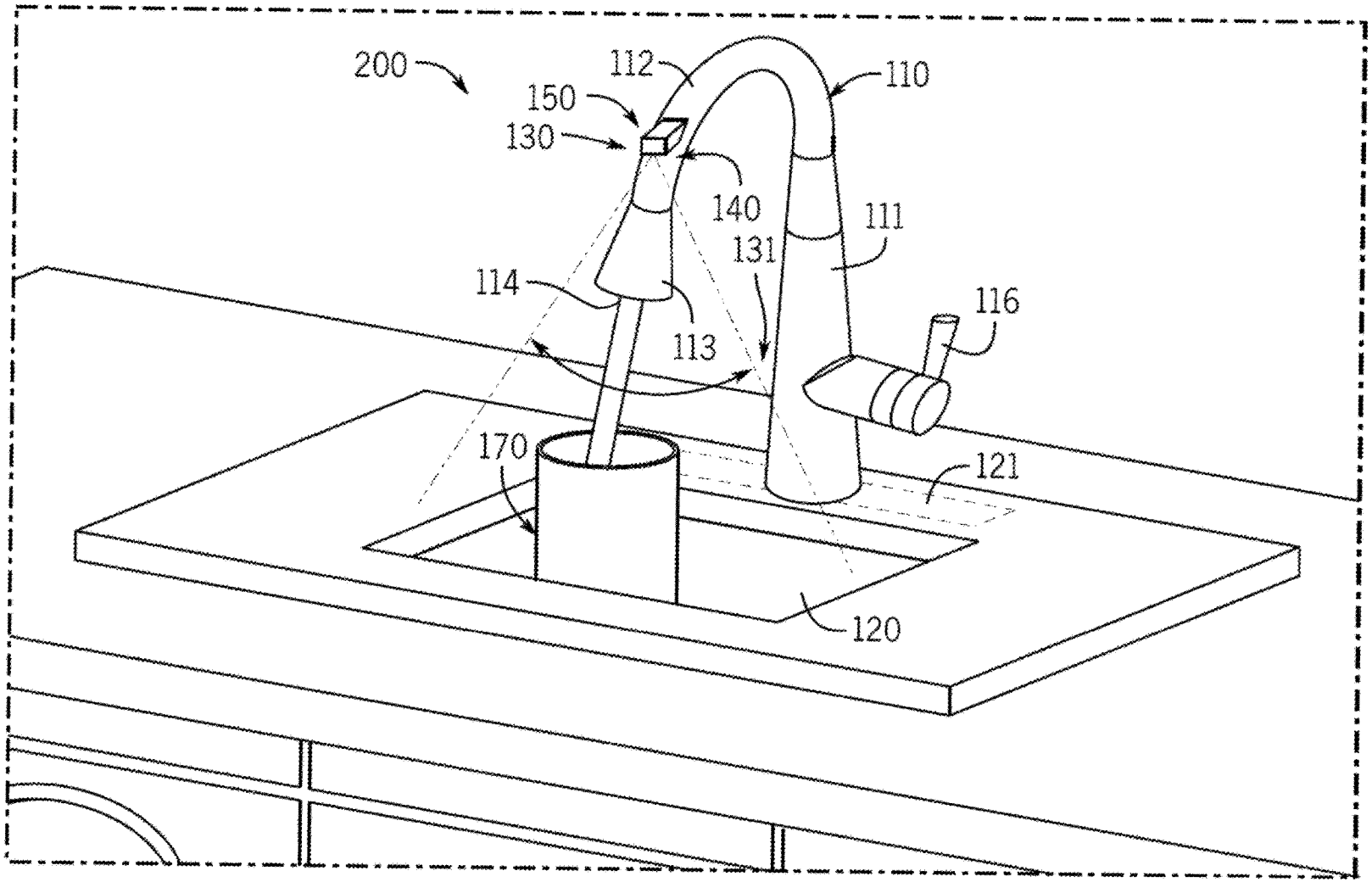
FIG. 2 illustrates a faucet in accordance with another example of the present disclosure.
Figure 3:
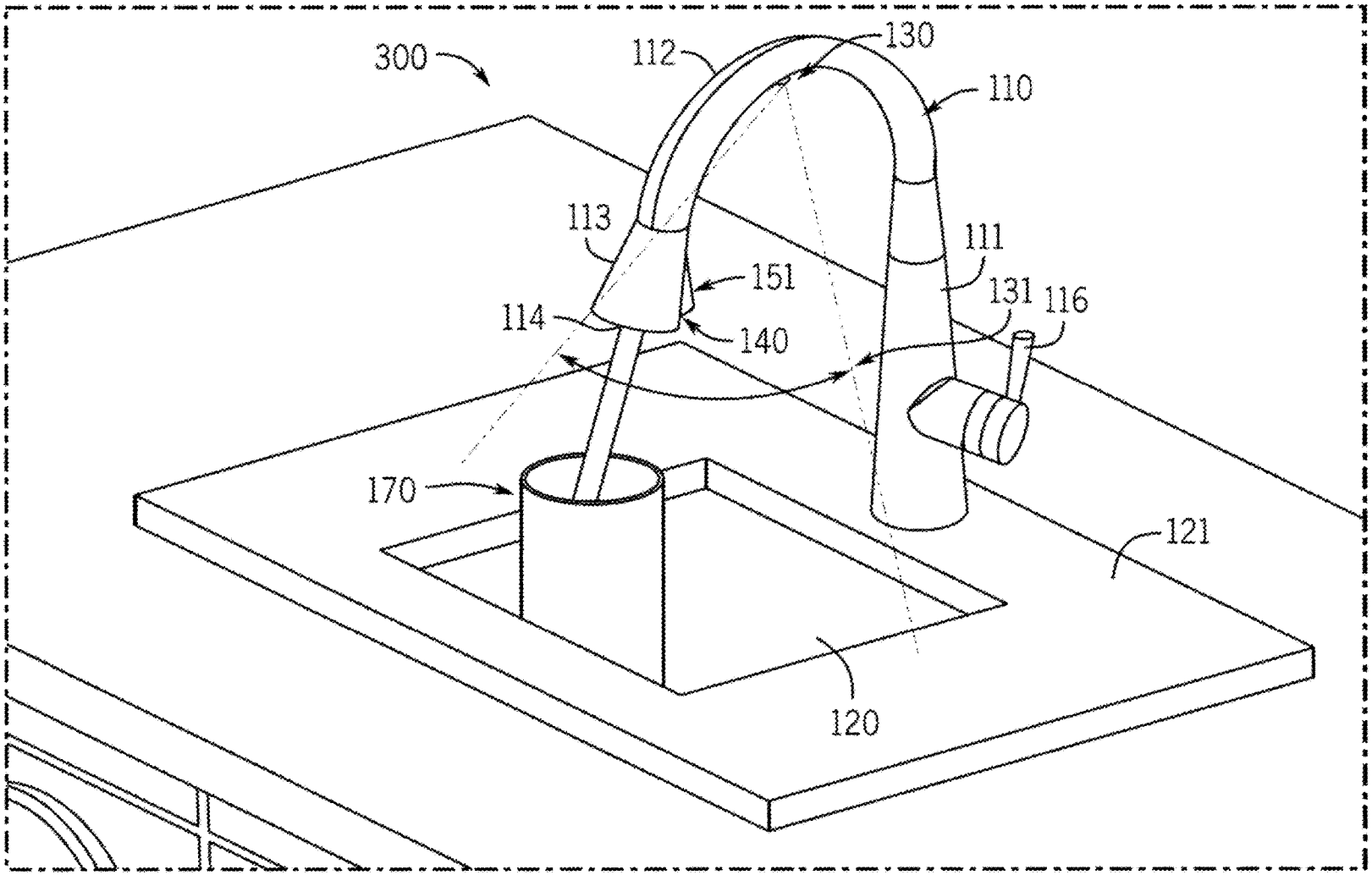
FIG. 3 illustrates a faucet in accordance with yet another example of the present disclosure.
Figure 4:
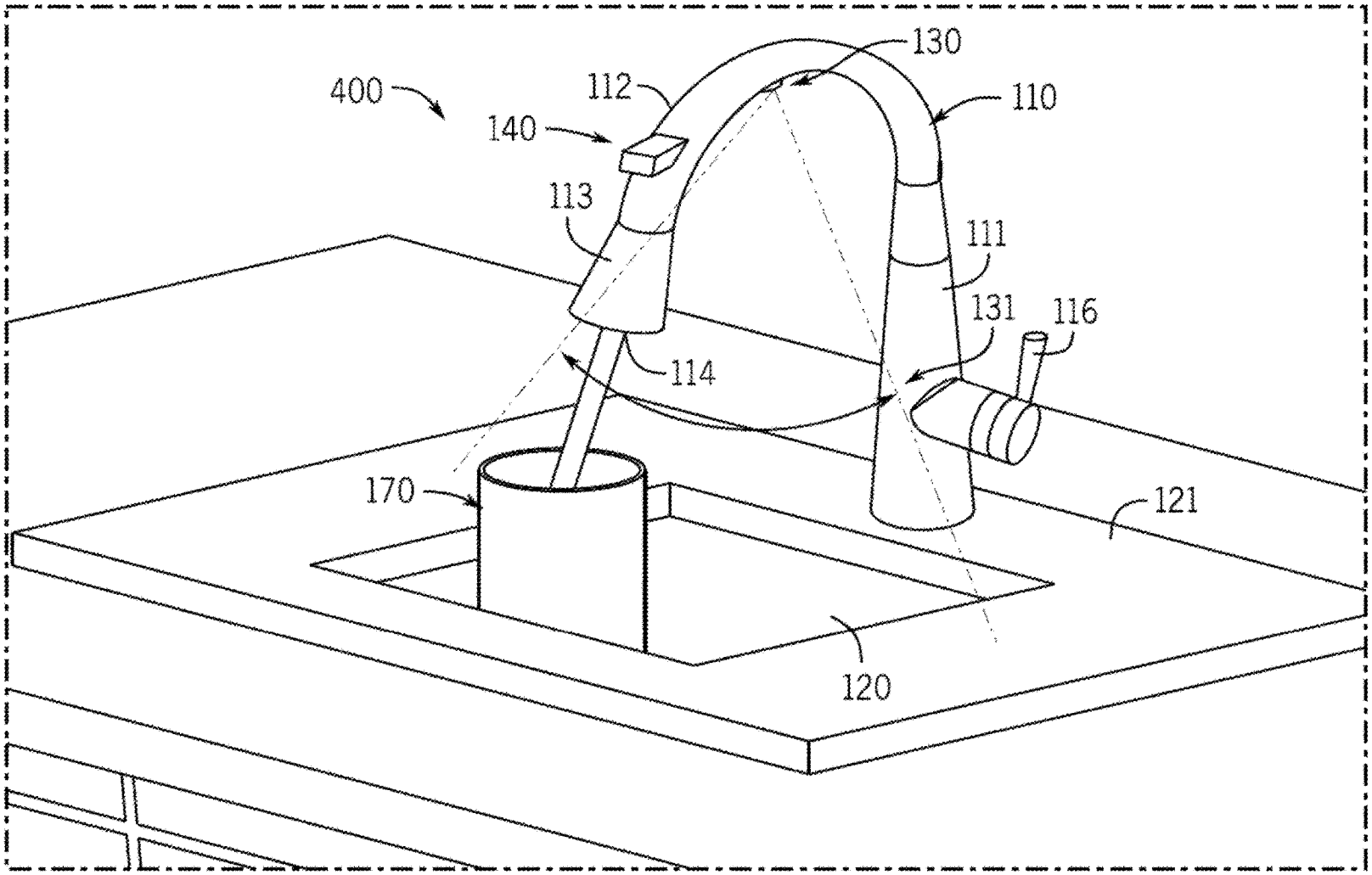
FIG. 4 illustrates a faucet in accordance with another example of the present disclosure.

As illustrated in FIGS. 1-4, the location of the image sensor 130 and/or the range sensor 140 may vary. Specifically, in some examples, as illustrated in FIG. 1, the image sensor 130 may be mounted or disposed on the extension portion 111 of the faucet 100. Further, as illustrated in FIG. 1, a range sensor 140 may be mounted or disposed on the end portion 113 of the faucet 100, for example, at a bottom end of the end portion 113. In another example, as illustrated in FIG. 2, the image sensor 130 may be disposed on the arched portion 112 of the faucet 200. Further, as illustrated in FIG. 2, a range sensor 140 may be mounted or disposed on the arched portion 112 of the faucet 200. Specifically, as illustrated in FIG. 2, the image sensor 130 and/or range sensor 140 may be disposed in a housing 150. In some examples, the housing 150 may extend or protrude (e.g., in a horizontal direction) from the arched portion 112 of the faucet 200 such that the image sensor 130 and range sensor 140 are disposed in front of the arched portion 112 of the faucet 200. According to other examples, a housing including one or both of the image sensor 130 and the range sensor 140 may extend from the extension portion 111 and/or the end portion 113. In another examples, as illustrated in FIG. 3, the image sensor 130 may be mounted or disposed on an underside of the arched portion 112 of the faucet 300. Further, as illustrated in FIG. 3, in some examples, the range sensor 140 may be mounted or disposed on the end portion 113 of the faucet 300. Specifically, as illustrated in FIG. 3, the range sensor 140 may be disposed in a housing 151. The housing 151 may extend or protrude (e.g., in a horizontal direction) from the arched portion of the faucet 300. In some examples, as illustrated in FIG. 3, the housing 151 may extend or protrude from the end portion 113, such that the range sensor 140 is disposed behind the end portion 113 of the faucet 300. In another example, as illustrated in FIG. 4, the image sensor 130 may be disposed on an underside of the arched portion 112 and the range sensor may be disposed in a housing 150 extending or protruding from the end portion 113 of the faucet 400. According to other examples, the image sensor 130 and/or range sensor 140 may be disposed in another location. For example, the image sensor 130 and/or range sensor 140 may disposed in or coupled to a ceiling above the faucet 100, 200, 300, 400, a wall proximate to the faucet 100, 200, 300, 400, or a surface (e.g., countertop) proximate to the faucet 100, 200, 300, 400, 700.

Figure 5:
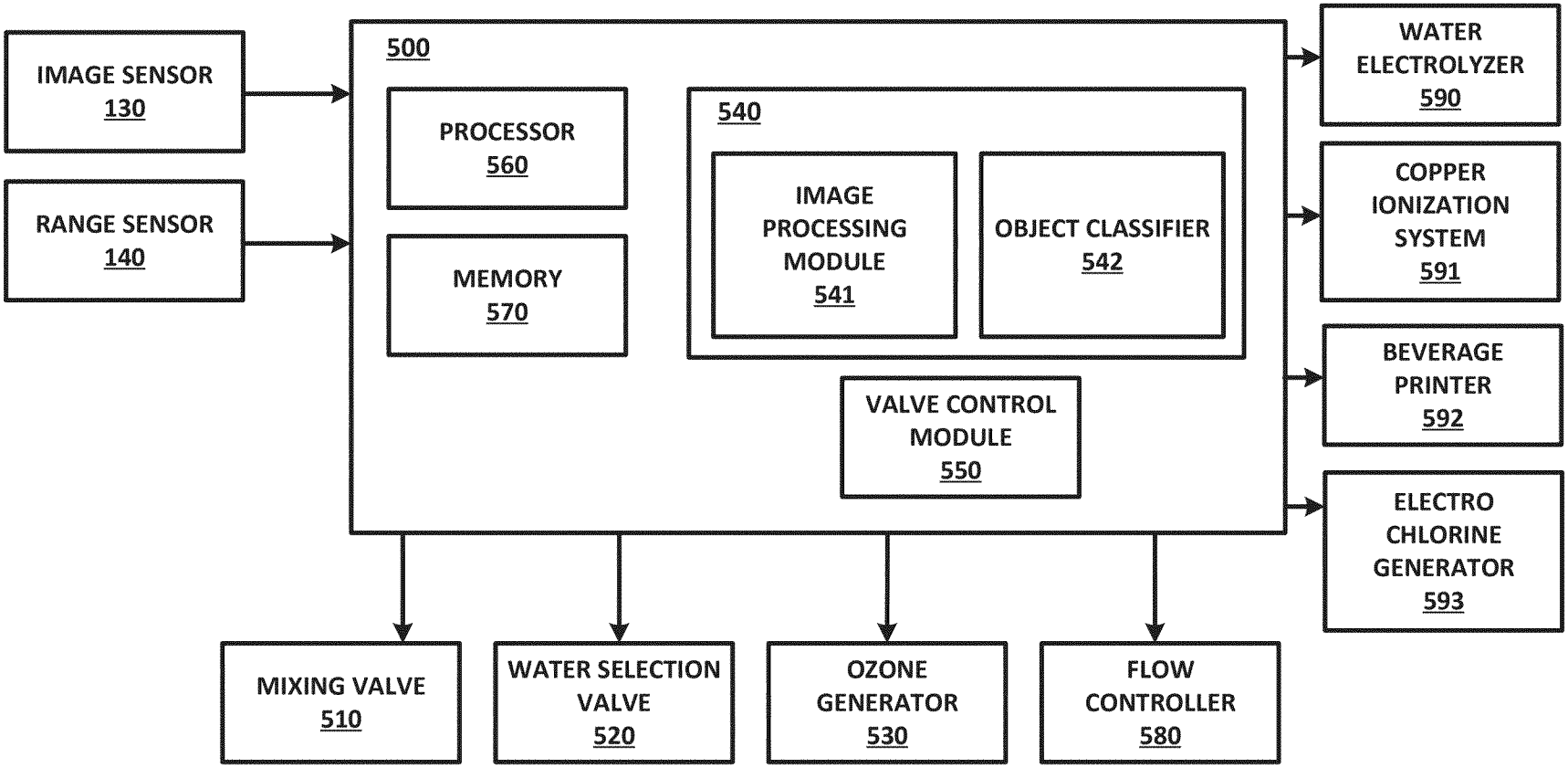
FIG. 5 illustrates a faucet control system in accordance with one example of the present disclosure.
Figure 6:
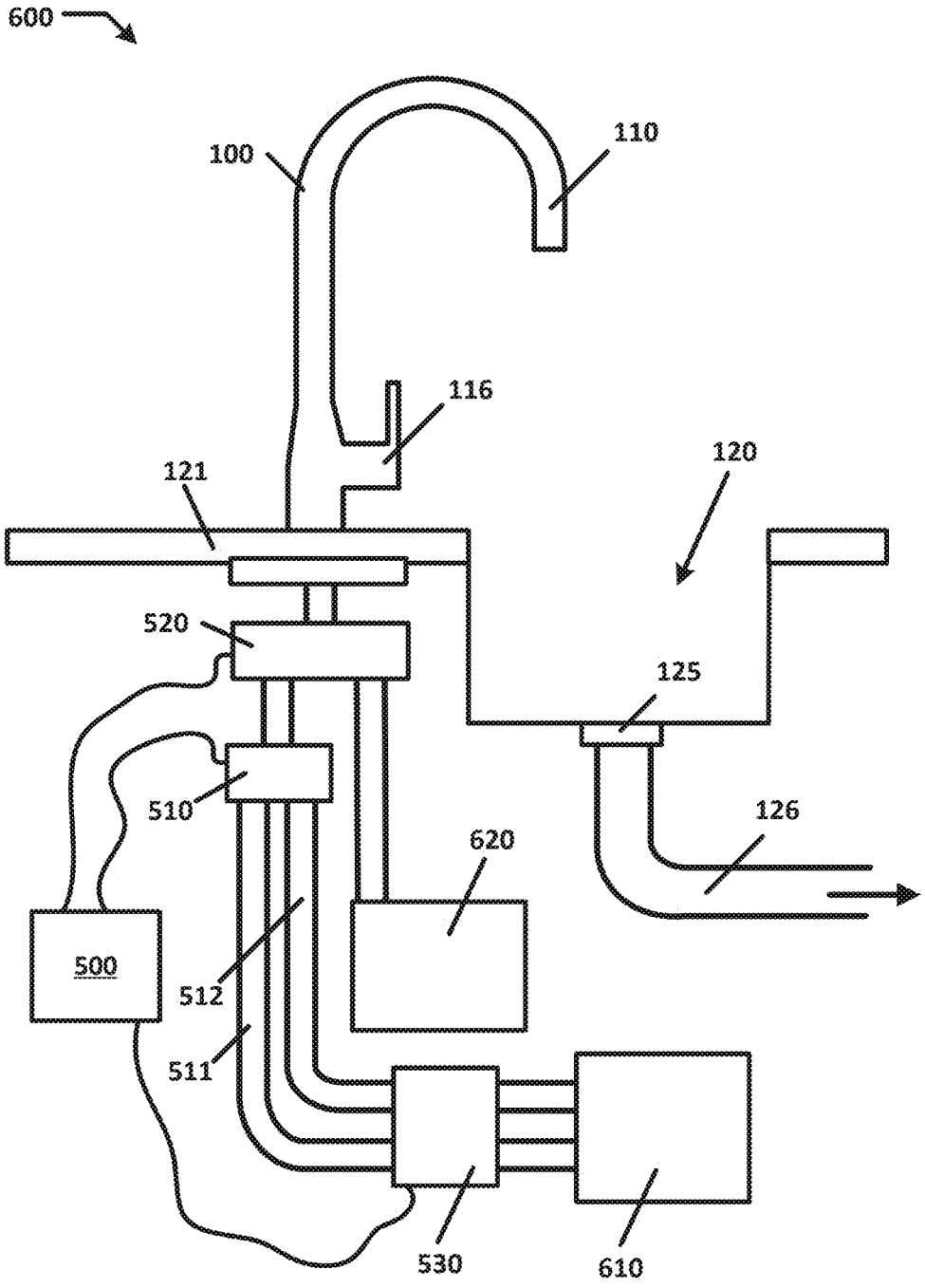
FIG. 6 illustrates a faucet control system in accordance with another example of the present disclosure.

Referring to FIG. 5, a faucet control system 500 in accordance with one example of the present disclosure is illustrated. The faucet control system 500 may be used to control any of the faucets 100, 200, 300, 400, 700 described herein. Referring to FIG. 6, a faucet control system 500 and a faucet 100 are illustrated in accordance with one example of the present disclosure. Generally, the faucet control system 500 is configured to control one or more of a mixing valve 510, a water selection valve 520, an ozone generator 530, a flow controller 580, a water electrolyzer 590, a copper ionization system 591, a beverage printer 592, and an electro chlorine generator 593. As illustrated in FIG. 5, the faucet control system 500 may include a processor 560 and memory 570. Further, the faucet control system 500 may include a data processing module 540 and a valve control module 550. The data processing module 540 and/or valve control module 550 may be implemented using the processor 560 and/or memory 570. For example, the memory 570 may store one or more sets of rules or algorithms for controlling the faucet (e.g., 100, 200, 300, 400, 700) and the processor 560 may implement or execute the one or more sets of rules or algorithms.

Returning to FIG. 5, in some examples, the faucet control system 500 may include an image sensor 130 and/or a range sensor 140. The image sensor 130 and/or range sensor 140 may be mounted or coupled to a faucet at one or more of the locations described above with respect to the faucets 100, 200, 300, 400 described above with respect to FIGS. 1-4. The image sensor 130 and/or range sensor 140 may be in communication with the faucet control system 500. Specifically, the image sensor 130 and/or range sensor 140 may be in communication with the processor 560 and/or memory 570 of the faucet control system 500. Further, the image sensor 130 and/or range sensor 140 may be in communication with the data processing module 540 and/or the valve control module 550. The faucet control system 500 may be in communication with the image sensor 130 and the range sensor 140 so as to receive image data and/or range data generated by the image sensor 130 and range sensor 140, respectively.

The mixing valve 510 may be configured to control or regulate flow from a hot water source and a cold water source. Referring to FIG. 6, the hot water source and the cold water source may be collectively referred to as a first water source 610. The first water source 610 may comprise a potable water plumbing network configured to supply or provide tap water. The mixing valve 510 may be in communication with a hot water conduit 511 and a cold water conduit 512 configured to provide hot and cold water, respectively, to the faucet 100. The mixing valve 510 may control a ratio or a quantity (e.g., flow rate, volume) of hot water and/or a quantity (e.g., flow rate, volume) of cold water supplied to faucet, thus controlling a temperature and/or flow rate of water dispensed from the faucet 100. Specifically, the faucet control system 500 may control the mixing valve 510 at least in part based on image data received from the image sensor 130 and/or range data received from the range sensor 140. In some examples, the mixing valve 510 may include on or more valve drivers configured to control the mixing valve 510. In some examples, an ozone generator 530 may be disposed along the hot water conduit 511 and/or the cold water conduit 512 between the first water source 610 and the mixing valve 510. In other examples, the ozone generator 530 may be disposed between the mixing valve 510 and the faucet 100, 200, 300, 400, 700, for example, between the mixing valve 510 and the water selection valve 520. One or more of the water electrolyzer 590, copper ionization system 591, and/or beverage printer 592 may be in communication with the mixing valve 510.

In some examples, as illustrated in FIG. 6, the faucet control system 600 may further include a drain valve 125 disposed at a bottom of the sink 120 and a drain pipe 126 configured to carry or direct fluid and/or waste away from the sink 120. In some examples, the processor 560 and/or valve control module 550 may generate one or more control signals for controlling (e.g., changing an open/closed state of) the drain valve 125 based at least in part on the image data received from the image sensor 130 and/or the range data received from the range sensor 140. For example, the processor 560 and/or valve control module 540 may generate a control signal causing the drain valve to move (e.g., actuate) to an open state when the image data or range data is indicative of splashing and/or overflow of the sink 120.

The water selection valve 520 may be configured to control or regulate a flow of water provided to a faucet 100, 200, 300, 400, 700 from two or more water sources. For example, referring to FIG. 6, the water selection valve 520 may control or regulate a flow of a first water type comprising tap water from a first water source 610 comprising a potable water plumbing network to the faucet 100. In some examples, as illustrated in FIG. 6, the water selection valve 520 may be disposed between the mixing valve 510 and the faucet 100. Further, the water selection valve 520 may control or regulate a flow of a second water type comprising pH controlled water from a second water source 620 comprising a tank or reservoir of pH controlled water. The pH controlled water may include, for example, alkaline water having a relatively high pH (e.g., for drinking) and/or acidic water having a relatively low pH (e.g., for cleaning/sanitization). As illustrated in FIG. 6, the water selection valve 520 may be disposed between the second water source 620 and the faucet 100.

In some examples, the water selection valve 520 may be configured to control or regulate a flow of water from both an alkaline water tank or reservoir and an acidic water tank storing alkaline and acidic water, respectively. In some examples, the water selection valve 520 may be configured to control or regulate a flow of filtered water from a filtered water tank or reservoir to the faucet 100. In some examples, the water selection valve 520 may comprise one or more valves, each of which is configured to control or regulate a flow of a respective water type or from a respective water source. For example, the water selection valve 520 may control or regulate a flow of water or fluid from one or more of the ozone generator 530, water electrolyzer 590, copper ionization system 591, beverage printer 592, and electro chlorine generator 593. In some examples, the water selection valve 520 may include one or more valve drivers configured to control the water selection valve 520.

The water selection valve 520 may be configured to control or regulate a type of fluid (e.g., tap water, pH controller water, filtered water) dispensed from a faucet 100, 200, 300, 400, 700. Specifically, in some examples, the water selection valve 520 may control or regulate a type of fluid provided to the faucet 100, 200, 300, 400, 700. Specifically, the faucet control system 500 may control the water selection valve 520 at least in part based on image data received from the image sensor 130 and/or the range data received from the range sensor 140. In some examples, the water selection valve 520 may include one or more valve drivers configured to control the water selection valve 520.

The flow controller 580 may be configured to control or regulate a flow type dispensed or conveyed from a faucet 100, 200, 300, 400, 700. Specifically, the flow controller 580 may control which outlet or outlets fluid flows through as it is dispensed from a faucet 100, 200, 300, 400, 700. In some examples, the location of an outlet or an arrangement (e.g., pattern) of outlets through which fluid is dispensed may dictate or control a flow type of fluid dispensed from the faucet 100, 200, 300, 400, 700. In some examples, one or more outlets may include a fluidic device, such as a nozzle or fluidic oscillator, configured to condition a flow of fluid dispensed from the faucet 100, 200, 300, 400, 700 to have a specific flow type.

Figure 7:
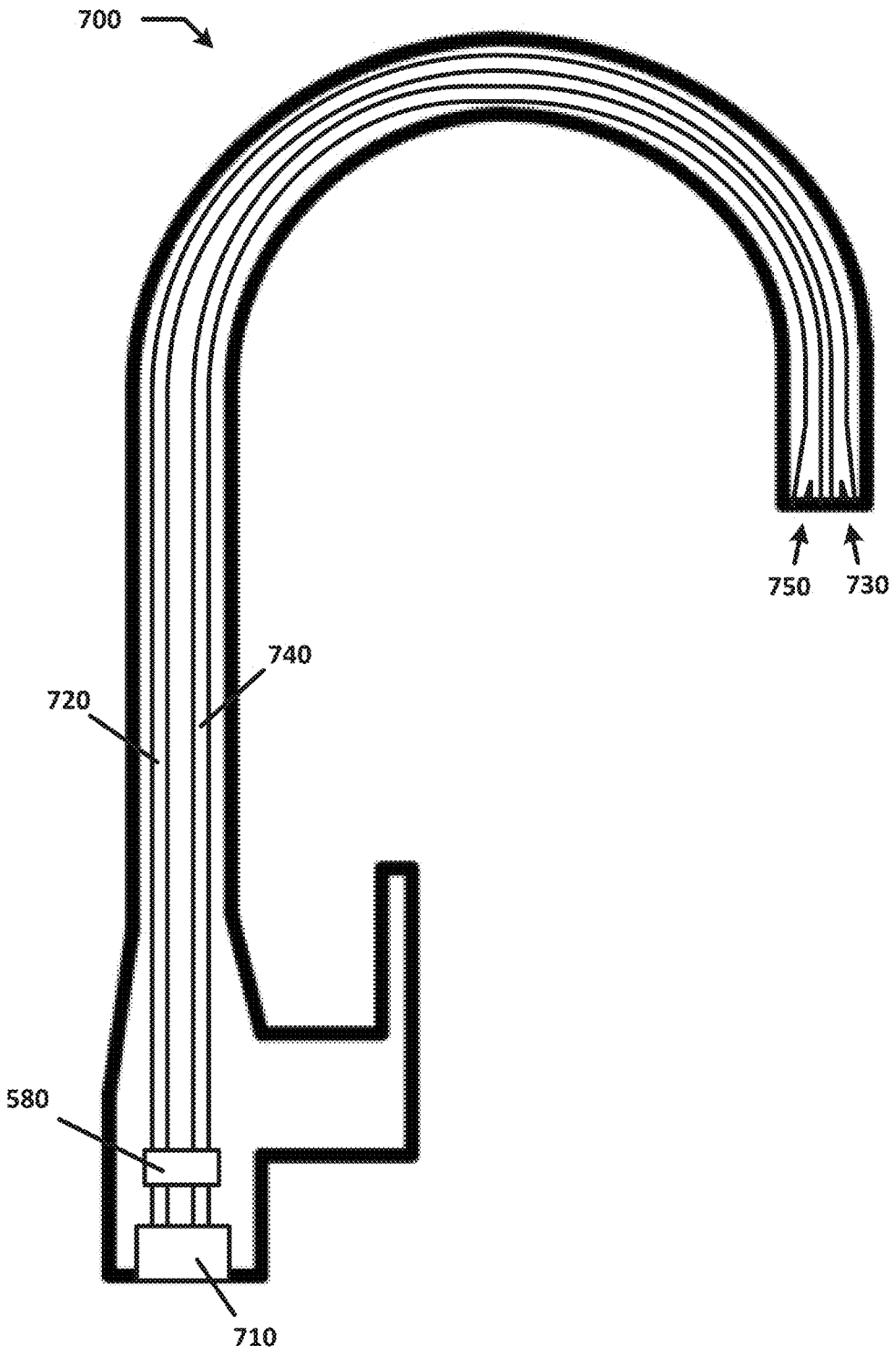
FIG. 7 Illustrates a faucet including a flow controller in accordance with one example of the present disclosure.

In some examples, as illustrated in FIG. 7, a faucet 700 may include an inlet 710 configured to receive a flow of fluid, for example, from the water selection valve 520. The faucet 700 may further include a first set of one or more channels 720 extending between and in communication with the inlet 710 and a first set of one or more outlets 730. Further, the faucet 700 may include a second set of one or more channels 740 extending between the inlet 710 and a second set of one or more outlets 750. According to some examples, one or more of the first set of one or more channels 720 and/or one or more of the second set of one or more channels 740 may include a fluidic device, for example, a nozzle or flow regulator configured to change a characteristic (e.g., flow rate) of water supplied the respective set of one or more outlets (e.g., 730, 750). In some examples, the flow controller 580 may be disposed along the first set of one or more channels 720 and the second set of one or more channels 740 and may be configured to selectively control a flow of fluid through the first set of channels 720 and/or the second set of channels 740. Accordingly, by controlling which set of channels (e.g., 720, 740) fluid is supplied to or flows through, the flow controller 580 may control which set of outlets (e.g., 730, 750) the fluid is dispensed from, thus controlling the flow type of fluid dispensed from the faucet 700.

Specifically, in one example, as illustrated in FIG. 7, the flow controller 580 may allow a flow of fluid to travel from the inlet 710, through the flow controller 580, through the first set of one or more channels 720, and through the first set of one or more outlets 730 into a sink (e.g., 120). In some examples, the first set of one or more outlets 730 may be configured to dispense a flow of fluid having a laminar flow type into a sink. For example, the first set of one or more outlets 730 may be a single outlet and/or include an aerator, creating a laminar flow.

Further, in one example, as illustrated in FIG. 7, the flow controller 580 may allow a flow of fluid to travel from the inlet 710, through the flow controller 580, through the second set of one or more channels 740, and through the second set of one or more outlets 750 into a sink. In some examples, the second set of one or more outlets 750 may include a plurality of outlets arranged in a pattern (e.g., along the bottom of an end portion 113 of a faucet) so as to create a sweeping flow type in which a blade (e.g., flat, wide) spray of fluid is dispensed from the faucet 700.

In other examples, the first and/or second set of one or more outlets 730, 750 may be arranged (e.g., in a pattern) so as to create a spray (e.g., conical) flow type, a soft (e.g., relatively low velocity) spray flow type, and/or an oscillating flow type. In some examples, the first and/or second set of one or more outlets 730, 750 may include one or more fluidic devices, such as a fluidic oscillator or a nozzle configured to condition a flow of fluid dispensed from the faucet 700. For example, one or more fluidic oscillators may be used to create an oscillating (e.g., back and forth) flow type. Further, one or more nozzles may be used to vary a velocity and/or flow rate of fluid dispensed from the faucet 700, for example, creating spray and/or soft spray patterns.

In other examples, a faucet 100, 200, 300, 400 may include a single channel extending therethrough, e.g., from an inlet 710 to one or more outlets (e.g., sets of outlets 730, 750). In these examples, the flow controller 580 may include a plurality of nozzles and/or fluidic devices, for example, arranged radially around a disc. The flow controller 580 may be configured to change a nozzle and/or fluidic device in line with the single channel of the faucet 100, 200, 300, 400, thus, changing a nozzle and/or fluidic device through which fluid is dispensed into the sink (e.g., 120) and a flow type of the fluid dispensed by the faucet 100, 200, 300, 400.

Returning to FIG. 5, the flow controller 580 may be configured to control or regulate the flow type of a fluid dispensed from a faucet 100, 200, 300, 400, 700. Specifically, in some examples, the flow controller 580 may selectively control a flow of fluid to first and/or second set of one or more channels 720, 740 and thus out of a first and/or second set of one or more outlets 730, 750. The first and second sets of one or more outlets may dictate or control a flow type of fluid dispensed from the faucet 100, 200, 300, 400, 700. In some examples, the flow controller 580 may be configured to selectively actuate (e.g., select, move, rotate, change) a nozzle and/or a fluidic device through which a flow of fluid is dispensed, controlling a flow type of water dispensed from the faucet, 100, 200, 300, 400. Specifically, the faucet control system 500 may control the flow controller 580 at least in part based on image data received from the image sensor 130 and/or the range data received from the range sensor 140. In some examples, the flow controller 580 may include one or more valve drivers configured to control the flow controller 580.

Figure 10:
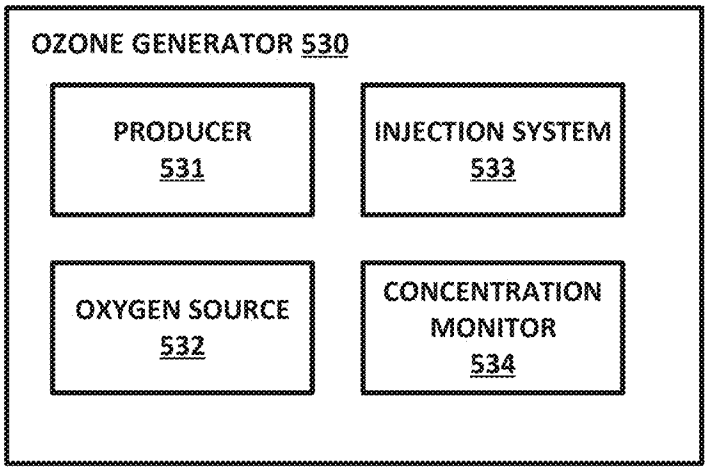
FIG. 10 illustrates an ozone generator in accordance with one example of the present disclosure.

The ozone generator 530 may be configured to selectively generate ozone ($O_3$) and/or introduce or entrain (e.g., generated) ozone into water. Specifically, as illustrated in FIG. 10, the ozone generator 530 may include a producer 531 configured to generate or produce ozone gas, for example, using corona discharge, ultraviolet (UV) light, and/or cold plasma technology. In some examples, a corona charger may be configured to accumulate electric charge from a power source and apply the electric charge to air from an air source. In corona discharge, a corona discharge tube or an ozone plate is used. In another example, an electrolytic ozone produces ozone by splitting water molecules. Such an ozone producer includes a water electrolysis device (e.g., water electrolyzer 590) that turns water molecules into $H_2$, $O_2$, and $O_3$. The hydrogen gas, $H_2$, may be removed to leave oxygen and ozone as the only products of the reaction. Electrolytic ozone generation may produce at higher concentrations (20-30%) than corona discharge technique. The electrolytic techniques may also avoid nitrogen gases. The ozone generator 530 may include an oxygen source 532. In some examples, the oxygen source 532 may be a volume of air proximate to the ozone generator 530. In these examples, oxygen may be supplied to the producer 531, for example, through an intake (e.g., vent). In some examples, a fan or pump may be used to supply oxygen to the producer 531. In other examples, the oxygen source 532 may be a tank (e.g., a pressurized tank) including oxygen (e.g., pure oxygen). Further, the ozone generator 530 may include an injection system 533 configured to introduce ozone into the water. The injection system 533 may include, for example, a venturi injector configured to use a pressure difference to draw ozone into the water, a diffuser or contact tank, and/or a bubbler. In some examples, the ozone generator 530 may further include a concentration monitor 534, for example, an ultraviolet (UV) light absorption analyzer configured to measure a quantity or concentration of ozone in water.

The ozone generator 530 may be configured to control or regulate a quantity (e.g., volume, concentration) of ozone in a flow of water supplied to a faucet 100, 200, 300, 400, 700.

Specifically, the ozone generator 530 may selectively generate ozone and/or selectively introduce or entrain ozone in a flow of water supplied to a faucet 100, 200, 300, 400, 700. The faucet control system 500 may control the ozone generator 530 at least in part based on image data received from the image sensor 130 and/or the range data received from the range sensor 140. According to some examples, as described hereinafter in greater detail, the faucet control system 500 may be configured to identify one or more gestures performed by a user. According to some examples, the faucet control system 500 may be configured to identify one or more gestures performed by a user for adjusting a concentration of ozone in a flow of water dispensed by the faucet 100, 200, 300, 400, 700. Accordingly, the faucet control system 500 may control the ozone generator 530 to increase or decrease a quantity or concentration of ozone entrained in a flow of water dispensed from the faucet 100, 200, 300, 400, 700.

As illustrated in FIG. 5, in some examples, the faucet control system 500 may include a water electrolyzer 590. In some examples, the water electrolyzer may include a tank configured to store electrolyzed water and/or in which electrolyzed water is generated. The water electrolyzer 590 is configured to electrolyze water (e.g., tap water, potable water) to generate hypochlorous acid using an electric charge and residual salt in the water. The electrolysis may produce HOCl, $O_3$, and/or $H_2O_2$. In some examples, additional salt (e.g., salt not residual in the water) may be added to the water electrolyzer (e.g., tank). Other byproducts such as hydrogen may be vented from the water electrolyzer 590.

The water electrolyzer may include two plates (e.g., a cathode plate and an anode plate). Each plate may be formed of a metal or conductive material. Each plate may be electrically connected to a power source directly or through processor 560 and/or valve control module 550. The anode may be disposable. For example, the user may remove and reinstall the anode at a time interval or as needed. Vinegar or peracedic acid may be added to the water as a reactant.

The processor 560 and/or valve control module 550 may provide one or more control signals and/or power (e.g., electric current) to the water electrolyzer 590. The water electrolyzer 590 may be configured to control or regulate a flow of electrolyzed water to a faucet 100, 200, 300, 400, 700. Specifically, the water electrolyzer 590 may selectively electrolyze water and/or supply electrolyzed water to the faucet 100, 200, 300, 400, 700 at least in part based on the image data received from the image sensor 130 and/or range data received from the range sensor 140. In some examples, the water selection valve 520 may be disposed between the water electrolyzer 590 and the faucet 100, 200, 300, 400, 700 such that the water selection valve 520 controls or regulates a flow of electrolyzed water to the faucet 100, 200, 300, 400, 700. For example, the water selection valve 520 may control or regulate a flow of water from a tank storing electrolyzed water to the faucet 100, 200, 300, 400, 700.

In some examples, as illustrated in FIG. 5, the faucet control system 500 may further include a copper ionization system 591. In some examples, the copper ionization system 591 may include a tank configured to store water including copper ions and/or in which copper ions are generated and added to water. The copper ionization system 591 may be configured to generate copper ions in a volume or flow of water. Copper ions generated by the copper ionization system 591 may advantageously disinfect the volume or flow of water, the various plumbing elements (e.g., conduits, valves) of the faucet 100, 200, 300, 400, 700 and/or the faucet control system 500, and/or an object disposed below the faucet 100, 200, 300, 400, 700.

The copper ionization system 591 may include two plates (e.g., a cathode plate and an anode plate). Each plate may be formed of a copper material (e.g., solid copper, copper alloy). Each plate may be electrically connected to a power source directly or through processor 560 and/or valve control module 550. The processor 560 and/or valve control module 550 may provide one or more control signals and/or power to the copper ionization. The copper ionization system 591 may be configured to control or regulate a flow of water including copper ions (e.g., copper ionized water). Specifically, the copper ionization system 591 may selectively generate copper ions and/or supply copper ionized water to the faucet 100, 200, 300, 400, 700 at least in part based on the image or image data received from the image sensor 130 and/or the range data received from the range sensor 140. In some examples, the water selection valve 520 may be disposed between the copper ionization system 591 and the faucet 100, 200, 300, 400, 700 such that water selection valve 520 controls or regulates a flow of copper ionized water to the faucet 100, 200, 300, 400, 700.

In some examples, the faucet control system 500 may further include a beverage printer 592. The beverage printer 592 may be configured to print or make one or beverages in-situ at the faucet 100, 200, 300, 400, 700 or faucet control system 500. For example, the beverage may be configured to print or make flavored water, carbonated flavored water, soda, and the like in-situ. In some examples, the beverage printer may receive tap water from a first water source. In other examples, the beverage printer may receive filtered water. In some examples, the beverage printer 592 may be configured to receive one or more containers or cartridges including a substance (e.g., liquid, powder, syrup etc.) configured to make flavored water, soda, or another beverage in-situ. Specifically, the beverage printer 592 may mix the substance for flavoring the beverage with water supplied to the beverage printer 592. Additionally or alternatively, in some examples, the beverage printer 592 may include a carbonation system including a carbon dioxide ($CO_2$) tank and a regulator configured to make carbonated beverages such as soda, carbonated water, and the like.

The processor 560 and/or valve control module 550 may provide one or more control signals to the beverage printer 592 and/or power to the beverage printer 592. The beverage printer 592 may be configured to make a plurality of different beverages based on a control signal or control signals received from the processor 560 and/or valve control module 550. The beverage printer 592 may selectively print or make beverages based at least in part on the image or image data received from the image sensor 130 and/or the range data received from the range sensor 140. For example, the beverage printer 592 may be configured to dispense a specific beverage based on a gesture performed by a user when a glass is disposed below the faucet 100, 200, 300, 400, 700.

In some examples, as illustrated in FIG. 5, the faucet control system 500 may include an electro chlorine generator 593. The electro chlorine generator 593 may include a tank configured to store electro chlorinated water and/or in which electro chlorinated water is generated. The electro chlorine generator 593 is configured to electrolyze salt water to generate sodium hypochlorite (NaClO) and hydrogen gas ($H_2$) using an electric charge and the salt (NaCl) in the salt water. In some examples, the electro chlorine generator 593 may generate sodium hypochlorite using sea water. In some examples, salt may be added to tap water or potable water creating the salt water for electro chlorination. Hydrogen may be vented from the electro chlorine generator 593.

The electro chlorine generator 593 may include two plates (e.g., a cathode plate and an anode plate). Each plate may be formed of a metal or conductive material. Each plate may be electrically connected to a power source directly or through 560 and/or valve control module 550. The processor 560 and/or valve control module 550 may provide one or more control signals and/or power (e.g., electric current) to the electro chlorine generator 593. The electro chlorine generator 593 may be configured to control or regulate a flow of electro chlorinated water to the faucet 100, 200, 300, 400, 700. Specifically, the electro chlorine generator 593 may selectively generate electro chlorinated water and/or supply the electro chlorinated water to the faucet 100, 200, 300, 400, 700 at least in part based on the image data received from image sensor 130 and/or range data received from the range sensor 140. In some examples, the water selection valve 520 may be disposed between the electro chlorine generator 593 and the faucet 100, 200, 300, 400, 700, such that the water selection valve 520 controls or regulates a flow of electro chlorinated water to the faucet 100, 200, 300, 400, 700.

The data processing module 540 may include an image processing module 541 and an object classifier 542. The image processing module 541 may be configured to process images or other data received from the image sensor 130. The image processing module 541 may be configured to identify objects included in images. The object classifier 542 may be configured to classify the objects in the images. The faucet control system 500 is configured to generate control signals for one or more of the mixing valve 510, water selection valve 520, ozone generator 530, flow controller 580, water electrolyzer 590, copper ionization system 591, beverage printer 592, and electro chlorine generator 593 to control fluid flow characteristics based on the classification of the objects in the images. Specifically, the faucet control system may generate control signals for one or more of the water selection valve 520, the ozone generator 530, the flow controller 580, the water electrolyzer 590, the copper ionization system 591, the beverage printer 592, and the electro chlorine generator 593 to control a flow attribute comprising a fluid type and a flow type based on the classification of an object or objects in the images.

In some examples, the image sensor 130 may be configured to collect images (e.g., image data) and/or other data in response to the range sensor 140 detecting the presence of an object below the faucet 100, 200, 300, 400, 700. The data processing module 540 may be configured to process data (e.g., ranging data) received from the range sensor 140. Specifically, the data processing module 540 may be configured to identify the presence and/or absence of an object below the faucet 100, 200, 300, 400, 700 based on the data received from the range sensor 140. The data processing module 540 may be configured to generate one or more control signals, for example, turning on or causing the image sensor to collect images or image data in response to a determination that an object is disposed below the faucet 100, 200, 300, 400, 700.

The processor 560 and memory 570 may form a processing circuit. The processor 560 may be configured to execute instructions stored in the memory 570 or may execute instructions otherwise accessible to the processor 560. In some examples, the one or more processors 560 may be embodied in various ways. The processor 560 may be constructed in a manner sufficient to perform at least the operations described herein. In some examples, the processor 560 may be shared by multiple circuits (e.g., circuit A and circuit B may comprise or share the same processor which, in some examples, may execute instructions stored, or otherwise accessed, via different areas of memory 570). Alternatively, or additionally, the processor 560 may be structure to perform or otherwise execute certain operations independent of one or more co-processors. In other examples, two or more processors 560 may be coupled via a bus to enable independent, parallel, pipelined, or multi-threaded instruction execution. Each processor 560 may be implemented as one or more general-purpose processors, application specific integrated circuits (ASICs), field programmable gate arrays (FPGAs), digital signal processors (DSPs), or other suitable electronic data processing components structure to execute instructions provided by memory. The processor 560 may take the form of a single core processor, multi-core processor (e.g., a dual core processor, triple core processor, quad core processor, etc.), microprocessor, etc.

The memory 570 may include non-transient volatile storage media, non-volatile storage media, non-transitory storage media (e.g., one or more volatile and/or non-volatile memories), etc. In some examples, the non-volatile media may take the form of ROM, flash memory (e.g., flash memory such as NAND, 3D NAND, NOR, 3D NOR, etc.), EEPROM, MRAM, magnetic storage, hard discs, optical discs, etc. In other examples, the volatile storage media may take the form of RAM, TRAM, ZRAM, etc. Combinations of the above are also included within the scope of machine-readable media. The memory 570 may store machine-readable executable instructions which are executed by the processor 560. In this regard, machine-executable instructions comprise, for example, instructions and data which cause a general purpose computer, special purpose computer, or special purpose processing machines to perform a certain function or group of functions. The memory 570 may be operable to maintain or otherwise store information relating to the operations performed by one or more associated circuits, including processor instructions and related data (e.g., database components, object code components, script components, etc.), in accordance with the examples described herein.

In some examples, at least some of the components of the of faucet control system 500 may execute locally. For instance, the processor 560 and memory 570 may be implemented, incorporated, or otherwise execute on a local computing device which is located at or near the faucet 100, 200, 300, 400, 700. For example, the local computing device may be mounted at or near a sink (e.g., 120) and/or a faucet 100, 200, 300, 400, 700. The faucet control system 500 is communicably coupled to the image sensor 130 and/or range sensor 140. The faucet control system 500 may be configured to execute locally to process data received from the image sensor 130 and/or range sensor 140 and control the one or more of the mixing valve 510, water selection valve 520, flow controller 580, the ozone generator 530, water electrolyzer 590, copper ionization system 591, beverage printer 592, and electro chlorine generator 593 based on, at least, the data from the image sensor 130 and/or range sensor 140.

The image sensor 130 may include a camera. The camera may include a lens and an image capture element. The image capture element can be any suitable type of imaging capture device or system, including, for example, an area array sensor, a Charge Coupled Device (CCD) sensor, a Complementary Metal Oxide Semiconductor (CMOS) sensor, or a linear array sensor, and the like. The image capture element may capture images in any suitable wavelength on the electromagnetic spectrum. The image capture element may capture color images and/or greyscale images. In other examples, the image sensor 130 may include other types of sensors configured to generate image data. For instance, the image sensor 130 may include an infrared sensor, a plurality of range sensors (e.g., 140), and the like.

The range sensor 140 may include a signal transmitter, a signal detector, and a timer. The range sensor 140 may be configured to transmit a signal into or toward a medium, for example, via the signal transmitter. The range sensor 140 may be configured to detect the signal reflected off of the medium, for example, using the signal detector. The range sensor 140 may be configured to calculate a distance or range between the signal transmitter and the medium based on a duration between the time in which the signal is transmitted and the reflected signal is detected. For example, the range sensor 140 may be an ultrasonic sensor, a radar sensor, a light detection and ranging (LIDAR) sensor, a sonar sensor, and the like. In some examples, the range sensor 140 is configured to detect or otherwise generate data corresponding to relative distances or depths. The range sensor 140 may be configured to transmit multiple signals toward a medium simultaneously or near simultaneously. The range sensor 140 may be configured to detect reflected signals. The range sensor 140 may be configured to detect or otherwise generate data corresponding to relative distances or depths based on the time in which the multiple signals are detected (e.g., following reflection off of the medium). The range sensor 140 may be configured to transmit multiple signals with a resolution sufficient to detect, for instance, a depth differential of various surfaces of an object. As one example, where a cup is positioned beneath the faucets 100, 200, 300, 400, 700, the range sensor 140 may be configured to detect a depth differential between a rim of the cup and a bottom of the cup. As the cup is filled with water, the depth differential may change.

According to some examples, the range sensor 140 may be a microwave or millimeter radar wave sensor. For example, the microwave radar sensor may emit electromagnetic wave signals and receive electromagnetic wave echo signals reflected by targets. Millimeter wave radar sensor with FMCW (Frequency Modulate Continuous Wave) technology is a high-precision radar ranging technology that generates an intermediate frequency signal with target distance and signal strength after mixing the microwave transmitted wave with the reflected wave of the target through a radio frequency (RF) circuit. The intermediate frequency signal is processed to obtain the distance, intensity, and speed of the targets. Based on these behavioral characteristics the sensor may identify the presence of an object, the location of an object, and/or the size and shape of an object.

According to some examples, the millimeter wave sensor may generate a plurality of measurements indicating a location at which the object is disposed and the millimeter wave sensor of the data processing module 540 may generate a point cloud for determining the size and shape of the object. According to some examples, the object may be classified based on a point cloud generated using a millimeter wave sensor.

In one example, the microwave or millimeter wave sensor is configured to detect the presence of one or more objects or motion of one or more objects. According to some examples, the microwave or millimeter wave sensor may be provided with a millimeter wave sensor module and a microcontroller unit (MCU). According to other examples, the processor 560 and/or the data processing module 540 may perform the functionality of the millimeter wave sensor. In one example, millimeter wave control unit, the microwave operating frequency can be selected as either 24 GHz or 60/77 GHz, with no frequency restrictions. According to some examples, the microwave operating frequency may be in the range of 20 GHz to 80 GHz.

The basic process of microwave ranging, and speed measurement is summarized according to the following. The transmission antenna (Tx chirp) of the millimeter wave sensor module transmits millimeter wave signal. The receiving antenna of the millimeter wave sensor module receives reflected waves (Rx chirp) when there is an object or user in the range (e.g., disposed below faucet 100, 200, 300, 400, 700). The emitted wave and reflected wave are mixed in the mixer to generate an intermediate frequency signal in the millimeter wave sensor. The MCU of the millimeter wave sensor performs fast Fourier transform (FFT) operation on the intermediate frequency signal to obtain the distance, intensity, and velocity information of the targets (e.g., objects disposed below the faucet 100, 200, 300, 400, 700). Based on the characteristics of radar signals, the presence of an object, a location of the object, and/or a size and shape of an object below the faucet 100, 200, 300, 400, 700 may be identified.

The faucet control system 500 includes a data processing module 540. The data processing module 540 is configured to process, interpret, or otherwise analyze data received from the image sensor 130 and/or range sensor 140. The data processing module 540 may include the image processing module 541 and the object classifier 542.

The image processing module 541 and the object classifier 542 may be or include any software, instructions, or other digital commands which are configured to process images received from the image sensor 130. In some examples, the image processing module 541 and/or object classifier 542 may be or include a neural network. The neural network may be a series of input layers, hidden layers, and output layer(s) which are configured to receive an input (e.g., an image), process the image to detect various characteristics within the image (e.g., at the hidden layer), and provide an output. The neural network may be trained prior to deployment. Hence, the neural network may be static at deployment (e.g., when processing images from the imaging sensor 130 in real-time).

The image processing module 541 may be or include software and/or hardware generally configured to identify objects within an image received from the image sensor 130. Since the image sensor 130 is mounted such that the image sensor's 130 field of view 131 includes a sink (e.g., 120), each of the images or the image date received from the image sensor 130 typically have fixed portions corresponding to the sink (e.g., 120). Hence, the images typically have a fixed (or set) background. The image processing module 541 may be configured to identify objects within images based on the difference between the background (e.g., the sink 120) and the images or image data received from the image sensor 130. The image processing module 541 may be configured to compare the images or image data received from the image sensor 130 to a static image of the sink (e.g., 120), for example, when no objected are present in the foreground of the image or the image data of the sink. The static image of the sink (e.g., 120) may be stored locally (e.g., within memory 570). The image processing module 541 may be configured to identify objects within the images based on the comparison (e.g., when there is a difference between the static image of the sink 120 and the images received from the image sensor 130). The image processing module 541 may be capable of distinguishing an object or objects placed in (e.g., on a bottom surface of) a sink (e.g., 120) from those held below the faucet 100, 200, 300, 400, 700 by a user.

The object classifier 542 may be or include software and/or hardware configured to assign a classification to objects in the images or the image data. The object classifier 542 may be configured to assign the classification by, for instance, identifying various features within the portion of the image corresponding to the object, based on object matching, object edge detection and matching, model matching, interpretation trees, and the like. The object classifier 542 may include, incorporate, or otherwise use algorithms corresponding to the above-mentioned methods for classifying objects. In some examples, the object classifier 542 may be configured to use data (e.g., range data) from the range sensor 140 in conjunction with the image or image data to assign a classification to the object. For instance, the object classifier 542 may be configured to use the range sensor 140 in conjunction with the image data to identify scale or size of the object, which may provide a further input to classify the object. According to some examples, as noted above, the object classifier 542 may be configured to classify an object based on a point cloud generated using sensor data collected by a microwave or millimeter wave sensor.

Additionally, in some examples, the images or image data generated by the image sensor 130 and/or the range date generated by the range sensor 140 may be indicative of one or more gestures performed by a user for controlling the faucet 100, 200, 300, 400, 700. The image sensor 130 and/or range sensor may detect one or more gestures performed below or in front of the faucet 100, 200, 300, 400, 700. Specifically, in some examples, the data processing module 540 may identify (e.g., classify) a user's hands in the image, image data, or range data. Further, the data processing module 540 may monitor or track a position of the user's hands over time to determine if one or more gestures for controlling the faucet 100, 200, 300, 400, 700 are performed. The gesture may be a wave or another specific gesture action (e.g., physical movement). In some examples, the data processing module 540 determine a change in distance between the image sensor 130 and/or the range sensor 140 and a user's hands when determined whether or not a user has performed one or more gestures for controlling the faucet 100, 200, 300, 400, 700. The faucet control system may be configured to direct a flow of fluid into the sink having a specific flow attribute based on one or more gestures detected by the faucet control system 500.

According to some examples, the image processing module 541 and/or the object classifier 542 may be configured to identify both an object disposed below the faucet 100, 200, 300, 400, 700 and a gesture performed by a user, and the faucet control system 500 may control a flow attribute of water dispensed by the faucet 100, 200, 300, 400, 700 based on both the identified object and the gesture.

In one example, the data processing module 540 may be configured to identify (e.g., classify) a user's hand and/or a user's finger and a drinking glass disposed below the faucet 100, 200, 300, 400, 700. Specifically, the data processing module 540 may identify a user's hand and/or finger based on images or image data received from the image sensor 130 and/or range data received from the range sensor 140. Further, in some examples, the data processing module 540 may identify a position of the user's hand or finger relative to the drinking glass and fill the drinking glass to a height (e.g., volume) corresponding to the position of user's hand or finger.

The valve control module 550 may be configured to generate control signals for one or more of the mixing valve 510, the water selection valve 520, the flow controller 580, the ozone generator 530, the water electrolyzer 590, the copper ionization system 591, the beverage printer 592, and the electro chlorine generator 593. In some examples, the valve control module 550 may be configured to generate control signals for a valve driver or valve drivers associated with one or more of the mixing valve 510, water selection valve 520, the flow controller 580, the ozone generator 530, the water electrolyzer 590, the copper ionization system 591, the beverage printer 592, and the electro chlorine generator 593.

The valve control module 550 and/or memory 570 may be configured to store fluid settings (e.g., temperature, volume, flow rate, fluid type, flow types) corresponding to various object classifications. Specifically, the valve control module 550 and/or the memory 570 may be configured to store a flow attribute comprising one of a fluid type or a flow type corresponding to various object classifications. In some examples, the valve control module 550 and/or memory 570 may store fluid settings and/or flow attributes as a look-up table. Each entry may correspond to an object classification. Each entry may include, for example, valve positions, durations for which valves are opened, a position of a flow controller 580, an on/off state of an ozone generator 530, and the like. In some examples, the fluid flow settings may be prestored settings (e.g., factory default settings). In some examples, a user may modify the fluid settings by updating an entry in the look-up table. The user may update various entries in the look-up table using, for example, an application executing on the user's mobile device. The user may update an entry in the look-up table via the mobile application, and the updated entry may be communicated from the mobile device to, for example, the valve control module 550 or memory 570 to update the look-up table.

The valve control module 550 may be configured to receive or add new entries to the look-up table. For instance, the user may select a "new entry" option on their mobile device. The user may capture and upload (e.g., via their mobile device) one or more photographs of the object, for instance, while the object is positioned in the sink 120 or otherwise beneath the faucet 100, 200, 300, 400, 700. The valve control module 550 may be configured to receive the photographs from the user's mobile device. The user may select fluid settings on the mobile device to provide when the object in the photographs is detected. The valve control module 550 may be configured to receive the fluid settings. The valve control module 550 may be configured to update the look-up table to the new entry from the user. Hence, the look-up table may be dynamic, in that a user may modify existing entries, add new entries, and so forth (e.g., including flow attributes).

The valve control module 550 may be configured to cross-reference a classification assigned to an object in an image or image data from the image sensor 130 with the look-up table to identify fluid settings, for example, a flow attribute, for the object below the faucet 100, 200, 300, 400, 700. The fluid settings may include, temperature, volume, flow rate, fluid type, flow types, and the like. The fluid settings may correspond to fluid characteristics of fluid flowing from the faucet 100, 200, 300, 400, 700. The valve control module 550 may control the mixing valve 510, water selection valve 520, flow controller 580, ozone generator 530, water electrolyzer 590, copper ionization system 591, beverage printer 592, and/or electro chlorine generator 593 in accordance with the fluid settings to achieve the one or more fluid characteristics from the mixing valve 510, water selection valve 520, flow controller 580, ozone generator 530, water electrolyzer 590, copper ionization system 591, beverage printer 592, and/or electro chlorine generator 593. Various examples of objects and corresponding fluid settings are provided below; however, the present disclosure is not limited thereto.

According to one example, a user may position their hands beneath a faucet 100, 200, 300, 400, 700. In some examples, the range sensor 140 and/or data processing module 540 may determine the presence of an object below the faucet and the image sensor may begin capturing images (e.g., image data). The image sensor 130 may then capture an image of the user's hands below the faucet. In other examples, the image sensor may continually (e.g., periodically) capture images of the contents of the sink 120. The image sensor 130 may transmit the image to the faucet control system 500. The image processing module 541 may identify the user's hands in the image based on a difference (or differences) between the background, for example, the sink 120 and the foreground, for example, the user's hands in the image. The object classifier 542 may assign a classification of "hands" to the object. The object classifier 542 may identify features of the object within the image. The valve control module 550 may identify the classification of the object assigned by the object classifier 542. The valve control module 550 may identify fluid settings or characteristics, specifically, a flow attribute, based on the object classification (e.g., by cross-referencing the assigned classification of the object with data in the look-up table). The valve control module 550 may generate control signals to one or more of the mixing valve 510, water selection valve 520, flow controller 580, the ozone generator 530, the water electrolyzer 590, the copper ionization system 591, the beverage printer 592, and electro chlorine generator 593 to adjust fluid settings based on the classification of the object positioned beneath the faucet.

In this example, the flow attributes may provide for tap water to be dispensed from the faucet with a laminar flow type. Further, the fluid settings may provide for warm water to de dispensed from the faucet for a predetermined period of time (e.g., 2 minutes). The valve control module 550 may control the water selection valve 520 to provide tap water (e.g., from a potable water plumbing network) to the faucet and may control the flow controller 580 such that water is dispensed through an outlet or outlets configured to provide a laminar flow.

In another example, a user may position a drinking glass or a water bottle beneath a faucet (e.g., 100, 200, 300, 400, 700). The image sensor 130 may capture an image of the drinking glass or the water bottle (e.g., in response to the range sensor 140 and/or data processing module 540 determining the presence of an object below the faucet). The image sensor 130 may transmit the image to the faucet control system 500. The image processing module 541 may identify drinking glass or water bottle in the image (e.g., based on a difference between the background and the drinking glass or water bottle). The object classifier 542 may assign a classification of "drinking glass" or "water bottle," respectively, to the object. The valve control module 550 may identify the classification of the object assigned by the object classifier 542. The valve control module 550 may identify fluid settings or characteristics, specifically, the flow attributes, based on the object classification and generate control signals to one or more of the mixing valve 510, water selection valve 520, flow controller 580, ozone generator 530, water electrolyzer 590, copper ionization system 591, beverage printer 592, and electro chlorine generator 593 to adjust fluid settings or characteristics based on the classification of the object placed below the faucet.

In this example, the flow attributes may provide for filtered water or pH controlled (e.g., alkaline) water to be dispensed from the faucet with a laminar flow type. Further, in some examples, the fluid settings may provide for cold water to be dispensed from the faucet. The valve control module 550 may control the water selection valve 520 to provide filtered water or pH controlled (e.g., alkaline) water to the faucet and control the flow controller 580 such that water is dispensed through an outlet or outlets configured to provide a laminar flow. In some examples, the range data generated by the range sensor 140 may be used by the data processing module 540 to determine a depth of the drinking glass or the water bottle and fill the drinking glass to a predetermined volume (e.g., 70% full, 85% full, etc.)

In another example, a user may position a dish (e.g., a dirty dish) beneath the faucet (e.g., 100, 200, 300, 400, 700) for cleaning. The image sensor 130 may capture an image of the dish (e.g., in response to the range sensor 140 and/or data processing module 540 determining the presence of an object below the faucet). The image sensor 130 may transmit the image to the faucet control system 500. The image processing module 541 may identify the dish in the image (e.g., based on a difference between the background and the dish). The object classifier 542 may assign a classification of "dish" to the object. The valve control module 550 may identify the classification of the object assigned by the object classifier 542. The valve control module 550 may identify fluid settings or characteristics, specifically, flow attributes, based on the object classification and generate control signals to one or more of the mixing valve 510, water selection valve 520, flow controller 580, ozone generator 530, water electrolyzer 590, copper ionization system 591, beverage printer 592, and electro chlorine generator 593 to adjust fluid settings or characteristics based on the classification of the object placed below the faucet.

In this example, the flow attributes may provide for tap water to be dispensed from the faucet with sweeping or blade (e.g., narrow and wide) flow type. Further, in some examples, the fluid settings may provide for hot water to be dispensed from the faucet. The valve control module 550 may control the water selection valve 520 to provide tap water to the faucet and control the flow controller 580 such that water is dispensed through an outlet or outlets configured to provide a sweeping or blade flow type.

In some examples, the data processing module 540 may determine a cleanliness classification or a level of contamination of the dish or another object beneath the faucet. For example, the image processing module may identify and determine a quantity (e.g., area, volume) of contaminant (e.g., food, etc.) on the dish. Further, in some examples, the object classifier 542 may assign a cleanliness classification to the dish (or another object) beneath the faucet. In some examples, the valve control module may identify flow settings, specifically, flow attributes, corresponding to the cleanliness classification and control one or more of the mixing valve 510, water selection valve 520, flow controller 580, ozone generator, water electrolyzer 590, copper ionization system 591, beverage printer 592, and electro chlorine generator 593 at least in part based on the cleanliness classification level of the object beneath the faucet. For example, a flow rate of fluid dispensed from the faucet may increase as the cleanliness classification decreases (as the object is more contaminated) and/or a flow type (e.g., flow attribute) may be selected in part based on the contamination level of the object.

In another example, a user may position a fruit or vegetable beneath a faucet (e.g., 100, 200, 300, 400, 700). The image sensor 130 may capture an image of the fruit or vegetable (e.g., in response to the range sensor 140 and/or data processing module 540 determining the presence of an object below the faucet). The image sensor 130 may transmit the image to the faucet control system 500. The image processing module 541 may identify the fruit or vegetable in the image (e.g., based on a difference between the background and the fruit or vegetable). The object classifier 542 may assign a classification of "fruit" or "vegetable", respectively, to the object. The valve control module 550 may identify the classification of the object assigned by the object classifier 542. The valve control module 550 may identify fluid settings or characteristics, specifically, a flow attribute, based on the object classification and generate control signals to one or more of the mixing valve 510, water selection valve 520, flow controller 580, ozone generator 530, water electrolyzer 590, copper ionization system 591, beverage printer 592, and electro chlorine generator 593 to adjust fluid settings or characteristics based on the classification of the object placed below the faucet.

In this example, the flow attributes may provide for ozone water or pH controlled water to be dispensed from the faucet with a soft (e.g., relatively low velocity) spray type for cleaning the fruit or vegetable. The valve control module 550 may control the ozone generator to produce and/or entrain ozone in a flow of water provided (e.g., from a potable water plumbing network) to the faucet. Further, the valve control module 550 may control the flow controller 580 such that water is dispensed through an outlet or outlets configured to provide a soft spray flow type.

In some examples, a field of view 131 of the image sensor 130 may include a portion or portions of a surface 121 (e.g., countertop) adjacent to the sink 120 and faucet 100, 200, 300, 400, 700. In these examples, the data processing module 540 (e.g., image processing module 541, object classifier 542) may be configured to identify or classify a surface adjacent the faucet 100, 200, 300, 400, 700. Additionally, the data processing module 540 may be configured to identify a volume of fluid (e.g., water) on the surface 121 proximate to the faucet. In these examples, when the data processing module 540, specifically, the image processing module 541 and/or object classifier 542 identifies a volume of water on the surface 121 adjacent to the sink, the valve control module may reduce a flow rate and/or change a flow type of water dispensed from the faucet to prevent additional water from traveling (e.g., splashing) outside of the sink 120. In some examples, when the data processing module 540 identifies a volume of water on the surface 121 adjacent to the sink 120, the valve control module 540 will send one or more control signals to drain valve 125 actuating the drain valve 125 to an open state.

According to some examples, a field of view 131 of the image sensor 130 and/or the range sensor 140 may include an area in which a user would stand at or in front of the faucet 100, 200, 300, 400, 700 when using the faucet 100, 200, 300, 400, 700. In these examples, the data processing module 540 may determine when a user is standing at or in front of the faucet 100, 200, 300, 400, 700. According to some examples, the faucet control system 500 may control the faucet 100, 200, 300, 400, 700 to automatically dispense a flow of water when a user is standing at the faucet 100, 200, 300, 400, 700. According to some examples, the image sensor 130 and/or the range sense 140, for example, a millimeter wave radar sensor may be configured to identify when a user steps or moves away from the faucet 100, 200, 300, 400, 700 and the faucet control system 500 may control the faucet 100, 200, 300, 400, 700 to stop dispensing a flow of water and/or reduce a flow rate of water dispensed from the faucet 100, 200, 300, 400, 700 when a user steps or moves away from the faucet 100, 200, 300, 400, 700.

In some examples, the faucet control system 500 may be configured to indicate when an object is placed below a faucet 100, 200, 300, 400, 700 and the processor 560 and/or image processing module 541 is not able to identify an object placed below the faucet. For example, the faucet control system 500 may be configured to cause an indicator light included in the faucet (e.g., 100, 200, 300, 400, 700) to illuminate or cause a speaker included in the faucet to produce a noise.

In some examples, the faucet control system 500 may be configured to indicate when no object is identified below the faucet 100, 200, 300, 400, 700. In one example, the faucet 100, 200, 300, 400, 700 may include an indicator light and the indicator light may illuminate when no object is disposed below the faucet 100, 200, 300, 400, 700. In another example, the indicator light may illuminate when an object is detected below the faucet 100, 200, 300, 400, 700, and remain off when no object is detected below the faucet 100, 200, 300, 400, 700. In some examples, the faucet 100, 200, 300, 400, 700 may include an indicator light configured to illuminate and/or a speaker configured to generate a noise when a faucet 100, 200, 300, 400, 700 is dispensing fluid and no object is detected or disposed below the faucet 100, 200, 300, 400, 700.

According to some examples, the faucet control system 500 may include a display or one or more indicator lights configured to display a type of water and/or a flow type of water dispensed by the faucet 100, 200, 300, 400, 700.

In some examples, the faucet control system 500 may receive an ambient temperature from a temperature sensor (e.g., thermometer) included in the faucet (e.g., 100, 200, 300, 400, 700) and adjust a temperature of fluid (e.g., using the mixing valve 510) based on an ambient temperature proximate. For example, when high temperature fluid is required, the faucet control system 500 may cause the mixing valve 510 to provide a fluid that is thirty degrees (e.g., Fahrenheit, Celsius) warmer than the ambient air proximate to the faucet.

In some examples, the faucet control system 500 (e.g., processor 560, image processing module 541) may be configured to determine a quantity of fluid in a sink 120 disposed below the faucet (e.g., 100, 200, 300, 400, 700) and may cause the faucet to stop dispensing fluid into the sink 120 when the sink is nearly (e.g., 85%, 90%, 95%) full to prevent the sink 120 from overflowing. In some examples, the faucet control system may further illuminate and indicator light or cause a speaker to generate a sound when the sink is nearly full. In some examples, the faucet control system 500 may cause a drain valve disposed in the sink or a drain pipe proximate to the sink to open when the sink 120 is nearly full.

In some examples, the processor 560 and/or the valve control module 550 may control the faucet 100, 200, 300, 400, 700 according to one or more learned models or neural networks. For example, one or more learned models or neural networks may be used to analyze (e.g., classify) an object below the faucet. Additionally, one or more learned models or neural networks may be used to select or identify a fluid setting based on the classified object. In some examples, a single learned model or neural network may classify an object disposed below the faucet 100, 200, 300, 400, 700 and select or identify a fluid setting based the identified object.

In some examples, a learned model for classifying an object and/or a learned model for selecting a fluid setting based on the classified object may be a multi-layered learned model or neural network wherein each layer comprises a different learned model or neural network for classifying an object and/or selecting a fluid setting. For example, a different learned model or neural network may be used to identify an object below the faucet, analyze raw image data including other objects besides the object of interest (e.g., objects disposed in the sink below the object of interest), and/or analyze a cropped image that is tight around the object of interest. In some examples, another learned model or neural network may receive an output from two or more constituent layers for classifying an object and/or selecting a fluid setting. In some examples, the image date may be provided to multiple neural networks at once (e.g., in parallel) and/or in series.

An image or image data (e.g., collected, generated by the image sensor 130) may be input into a learned model for identifying or classifying an object and the learned model may output a classification of an object included in the image or image data. The learned model for identifying or classifying objects may be trained with objects having known classifications. In some examples, a ground truth set of images including objects having known classifications may be input into the learned model. In some examples, manual (e.g., human) verification of object classifications may be used to train the learned model.

In some examples, different learned models may be developed (e.g., trained) for different applications. For example, a different learned model may be trained for each of faucets disposed in a kitchen and faucets disposed in a bathroom. Example, classifications, as noted above, include, hands, dishes, a drinking glass, a water bottle, a fruit, a vegetable, a tooth brush, and the like.

In some examples, a learned model or learned models may be used to identify or classify a cleanliness of an object disposed below the faucet 100, 200, 300, 400, 700. The learned model for classifying a cleanliness of an object may be trained with objects having known cleanliness classifications. In some examples, a fluid setting (e.g., fluid type, fluid flow type) may be selected at least in part, based on a cleanliness classification of the object.

In some examples, a learned model or neural network may be configured to adjust a fluid setting corresponding to a classified object. Specifically, a learned model or neural network may be configured to adjust a (e.g., stored) fluid setting corresponding to a classified object when a user manually adjusts a fluid setting when the classified object is disposed below the faucet 100, 200, 300, 400, 700. For example, if when it is determined that a drinking glass is disposed below the faucet, the faucet dispenses fluid having a temperature of 50° Fahrenheit and a user manually adjust the faucet to dispense a fluid having a temperature of 40° Fahrenheit, the learned model may decrease a (e.g., stored) fluid temperature associated with the drinking glass. In one example, the learned model may decrease a fluid temperature associated with drinking glass by a difference between the stored temperature and the manually set temperature time a multiplier (e.g., 0.3). One or more equations may be used to adjust a fluid setting, for example, Stored Temperature±Multiplier×|Stored Temperature−Manually Set Temperature|. In other examples, the learned model may be configured to change another fluid setting, such as, f type and/or flow type based on one or more manual adjustments by a user. In some examples, the learned model may continuously adjust a fluid setting associated with the classified object. Similarly, if a user manually changes a water type and/or a flow type of water dispensed by the faucet 100, 200, 300, 400, 700 (e.g., a threshold number of times) when a classified object is disposed below the faucet 100, 200, 300, 400, 700, the learned model may change a water type and/or flow type associated with the classified object.

Figure 8:
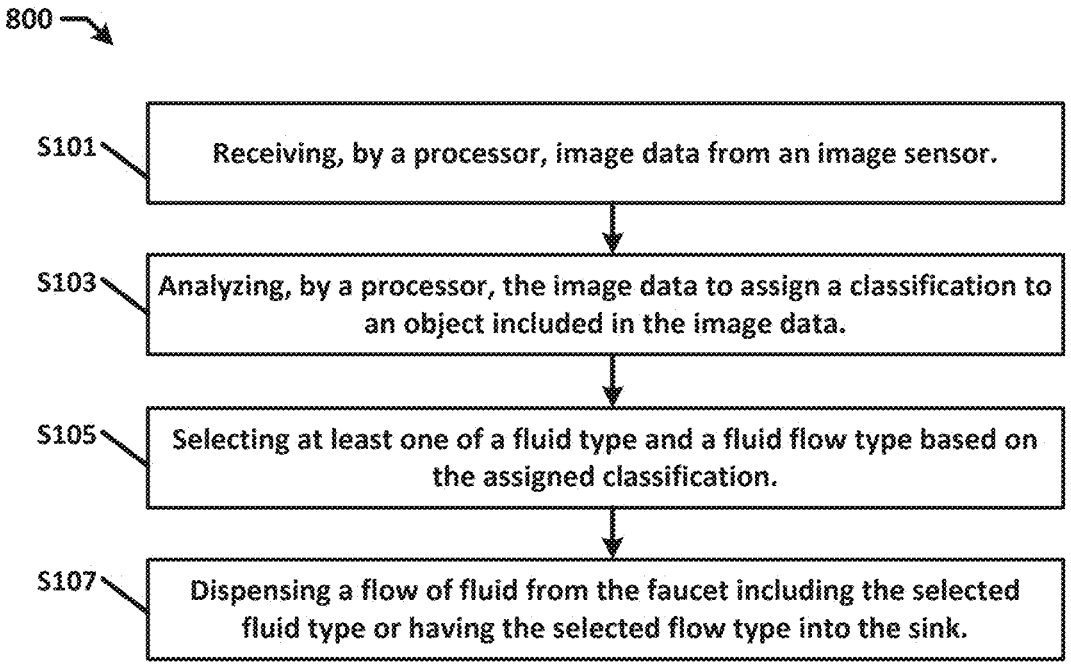
FIG. 8 illustrates a flow chart for controlling a faucet according to one example of the present disclosure.

Referring to FIG. 8, a flowchart 800 for controlling a faucet in accordance with one example of the present disclosure is illustrated. The flowchart 800 for controlling a faucet may be used with the faucet control system 500 and any of the faucets 100, 200, 300, 400, 700 described herein. Additional, different, or fewer acts may be provided.

In a first act S101, a faucet control system 500 receives an image or image data from an image sensor 130. Specifically, a processor 560 and/or image processing module 541 may receive the image or image data from the image sensor 130.

In a second act, S103 a faucet control system 500 may analyze the image or image data received from the image sensor to assign a classification to an object included in the image or the image data. Specifically, the processor 560 and/or the image processing module 541 and the object classifier may analyze the image or the image data to assign a classification. For example, the processor 560 or image processing module 541 may identify the object in the image based on a difference or differences between the background (e.g., sink 120) and the foreground or object below the faucet. Further, the processor 560 or object classifier 542 may assign a classification to the object. For example, the processor 560 or object classifier 542 may identify features of the object and classify the object based on the identified features.

In a third act S105, at least one of a fluid type and a fluid flow type (e.g., flow type) may be selected based on the assigned classification. Specifically, the valve control module 550 may identify the classification of the object assigned by the object classifier 542 and may identify fluid settings or characteristics, for example, fluid type and flow type based on the object classification. For example, the by cross-referencing the assigned classification of the object with data in a look-up table.

In a fourth act S107, a flow of fluid including the selected fluid type or having the selected flow type is dispensed from the faucet. Specifically, the valve control module 550 may generate one or more control signals for one or more of the mixing valve 510, water selection valve 520, flow controller 580, ozone generator 530, water electrolyzer 590, copper ionization system 591, beverage printer 592, and electro chlorine generator 593 to adjust fluid settings (e.g., fluid type, fluid flow type) based on classification of object positioned beneath the faucet. Further, the valve control module 550 may control or cause the faucet to dispense a flow of fluid having the selected or assigned fluid settings (e.g., fluid type, fluid flow type) into the sink 120.

In some examples, the flowchart 800 may further include an act of receiving, by the faucet control system 500 (e.g., processor 560, data processing module 540) range data from the range sensor 140, the range data indicating a presence of an object below the faucet.

Figure 9:
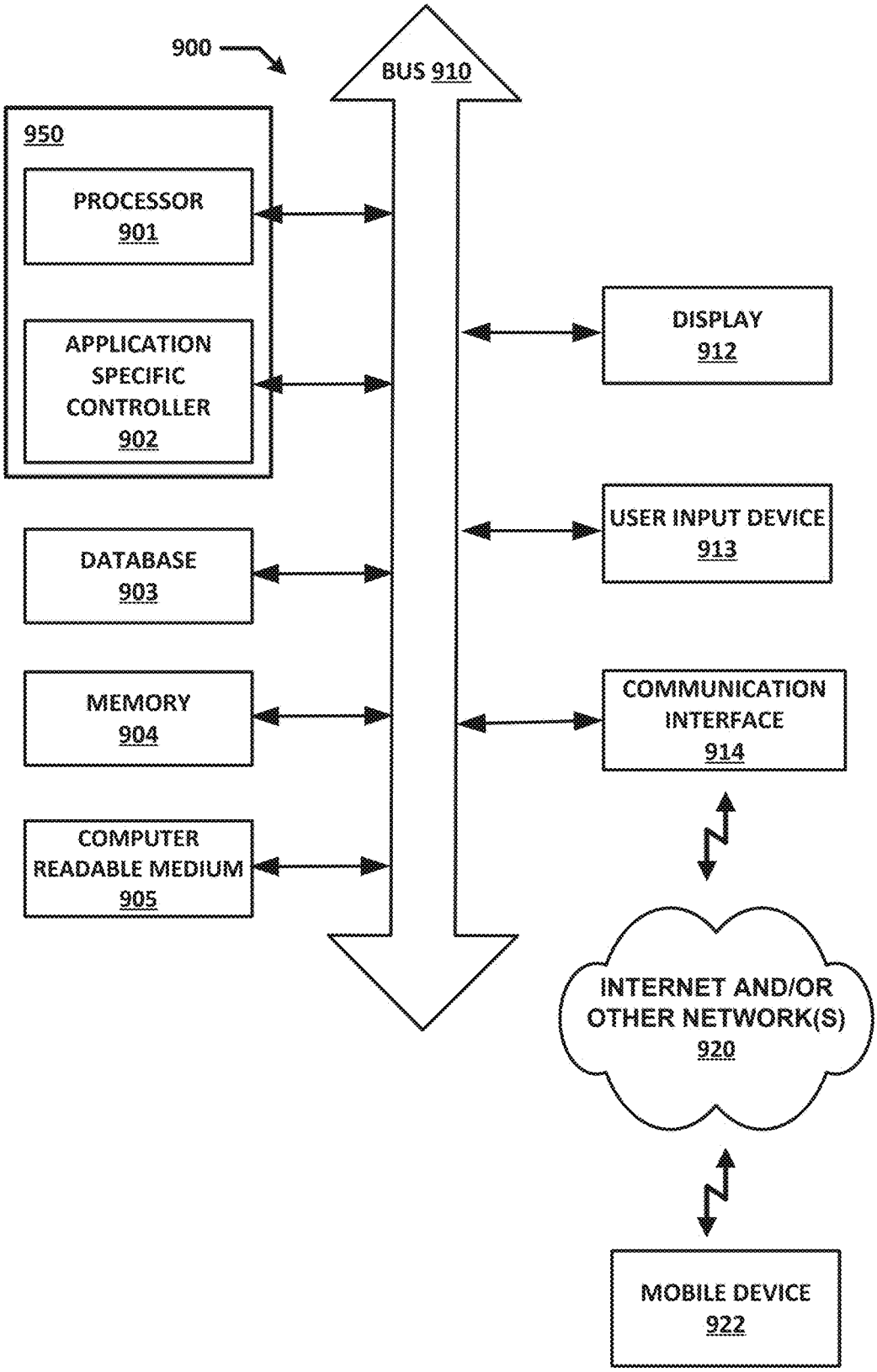
FIG. 9 illustrates an apparatus for controlling a faucet in accordance with one example of the present disclosure.

Referring to FIG. 9, an apparatus 900 for controlling a faucet (e.g., 100, 200, 300, 400, 700) in accordance with one example of the present disclosure is illustrated. In some examples, the apparatus 900 may be implemented as the faucet control system 500. The apparatus 900 includes a bus 910 facilitating communication between a controller 950 that may be implemented by a processor 901 and/or application specific controller 902 and one or more components including a database 903, a memory 904, a computer readable medium 905, display 912, a user input device 913, and a communication interface 914.

The contents of the database 903 may include, for example, a look-up table including object classifications and one or more flow settings associated with or corresponding to each object classification. The memory 904 may be a volatile memory or a non-volatile memory. The memory 904 may include one or more read only memory (ROM), random access memory (RAM), a flash memory, an electronic erasable program read only memory (EEPROM), or other type of memory. The memory 904 may be removable from the apparatus 900, such as a secure digital (SD) memory card.

The memory 904 and/or the computer readable medium 905 may include a set of instructions that can be executed to cause the controller to perform any one or more of the methods or computer-based functions disclosed herein. For example, the controller 950 may send one or more controller signals and/or electric current to one or more of the mixing valve 510, water selection valve 520, flow controller 580, and ozone generator 530, for example, performing various acts of the flowchart 800.

A user may enter a new object classification and/or update a look-up table including object classifications and associated fluid settings using the display 912 and/or user input device 913. The display 912 may comprise a screen and the user input device 913 may comprise one or more buttons on the apparatus 900. In some examples, the display 912 and user input device 913 may comprise a touch sensitive surface (i.e., a touch screen). In some examples, the user input device 913 may include a microphone configured to receive one or more verbal or voice activation commands for controlling the faucet.

The communication interface 914 may be connected to the network 920, which may be the internet. In some examples, the network 920 may be connected to one or more mobile devices 922. The one or more mobile devices may be configured to send a signal to the communication interface 914 via the network 920. For example, one or more mobile devices may send a signal to the communication interface to enter a new object classification and/or update a look-up table including object classifications and associated fluid settings.

The communication interface 914 may include any operable connection. An operable connection may be one in which signals, physical connections and/or logical communications may be sent and/or received. An operable connection may include a physical interface, an electrical interface, and/or a data interface. The communication interface 914 provides for wireless and/or wired communications in any known or later developed format.

According to some examples, the apparatus 900 for controlling a faucet 100, 200, 300, 400, 700 may be implemented on a stand alone battery operated device (e.g., a wireless puck). For example, a wireless puck may be disposed proximate to the faucet 100, 200, 300, 400, 700, for example, in a sink 120, or on a surface 121 (e.g., countertop) proximate to the faucet 100, 200, 300, 400, 700.

When a component, device, element, or the like of the present disclosure is described as having a purpose or performing an operation, function, or the like, the component, device, or element should be considered herein as being "configured to" meet that purpose or to perform that operation or function.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A system for controlling a faucet, the system comprising:

a faucet including a spout configured to direct a fluid into a sink;

an image sensor configured to collect image data; and a processor configured to analyze the image data and assign a classification to an object included in the image data, select a flow attribute based on the assigned classification, and cause the faucet to direct a flow of fluid having the selected flow attribute into the sink, wherein the processor is configured to analyze the image data and classify a surface adjacent to the faucet, analyze the image data and classify a volume of fluid on the surface, and control the faucet to reduce a flow rate of fluid directed into the sink or change a flow type of fluid directed into the sink or change a state of a drain valve.

2. The system of claim 1, further comprising:

a range sensor configured to detect an object below the spout, wherein the image sensor is configured to collect image data in response to the range sensor detecting an object below the faucet.

3. The system of claim 1, further comprising:

a water selection valve configured to provide a selected fluid type to the faucet, wherein the selected fluid type is tap water from a plumbing network or pH controlled water from a pH controlled water tank.

4. The system of claim 1, further comprising:

an ozone generator or electro chlorine generator configured to selectively entrain ozone in a flow of water supplied to the faucet or supply electro chlorinated water to the faucet based on a selected fluid type, wherein the selected fluid type is tap water from a plumbing network, ozone water, or electro chlorinated water.

5. The system of claim 1, wherein the faucet further comprises:

an inlet configured to receive a fluid;

a first set of one or more outlets disposed at the spout and configured to dispense a flow of water having a first flow type;

a second set of one or more outlets disposed at the spout and configured to dispense a flow of water having a second flow type; and a flow type valve configured to selectively provide the fluid received at the inlet to one of the first set of one or more outlets and the second set of one or more outlets based on the selected flow attribute.

6. The system of claim 5, further comprising:

a first set of channels extending between the inlet and the first set of one or more outlets; and a second set of channels extending between the inlet and the second set of one or more outlets, wherein the flow type valve is configured to selectively provide the fluid received at the inlet to the first set of channels or the second set of channels.

7. The system of claim 5, wherein the first flow type is one of a soft spray, a sweeping flow, and a laminar flow and the second flow type is a different one of the soft spray, the sweeping flow, and the laminar flow.

8. The system of claim 1, wherein the selected flow attribute is a fluid type including one of tap water, pH controlled water, ozone water, electro chlorinated water, temperature controlled water, or filtered water.

9. The system of claim 1, wherein the processor is configured to analyze the image data and assign a cleanliness classification to the object and cause the spout to direct fluid into the sink having at least one of a flow rate or a flow duration based on the assigned cleanliness classification.

10. A faucet comprising:

a spout configured to direct a flow of water into a sink;

an image sensor configured to collect image data; and a processor configured to analyze the image data and assign a classification to an object included in the image data, select a flow attribute based on the assigned classification, and cause the faucet to direct a flow of fluid having the selected flow attribute into the sink, wherein the processor is configured to analyze the image data and classify a surface adjacent to the faucet, analyze the image data and classify a volume of fluid on the surface, and control the faucet to reduce a flow rate of fluid directed into the sink or change a flow type of fluid directed into the sink or change a state of a drain valve.

11. The faucet of claim 10, further comprising:

a range sensor configured to detect an object below the faucet, wherein the image sensor is configured to collect image data in response to the range sensor detecting an object below the faucet.

12. The faucet of claim 10, further comprising:

an inlet configured to receive a fluid;

a first set of one or more outlets disposed at the spout and configured to dispense a flow of water having a first flow type;

a second set of one or more outlets disposed at the spout and configured to dispense a flow of water having a second flow type; and a flow type valve configured to selectively provide the fluid received at the inlet to one of the first set of one or more outlets and the second set of one or more outlets based on the selected flow attribute.

13. The faucet of claim 1, wherein the processor is configured to analyze the image data and assign a cleanliness classification to the object and cause the spout to direct fluid into the sink having at least one of a flow rate or a flow duration based on the assigned cleanliness classification.

14. A method of controlling a faucet, the method comprising:

receiving, by a processor, image data from an image sensor disposed on a faucet;

analyzing, by the processor, the image data to assign a classification to an object included in the image data;

selecting a flow attribute based on the assigned classification;

dispensing a flow of fluid from the faucet having the flow attribute into a sink;

analyzing, by the processor, the image data and classifying a surface adjacent to the faucet;

analyzing, by the processor, the image data and classifying a volume of fluid on the surface; and controlling, by the processor, the faucet to reduce a flow rate of fluid directed into the sink or change a flow type of fluid directed into the sink or change a state of a drain valve.

15. The method of claim 14, further comprising:

receiving, by the processor, range data from a range sensor, the range data indicating a presence of the object below the faucet.

16. The method of claim 15, wherein the image data is generated by the image sensor and sent to the processor in response to the processor receiving the range data from the range sensor indicating the presence of the object below the faucet.

17. The method of claim 14, wherein the selecting a flow attribute comprises cross-referencing, by the processor, the classification assigned to the object with a look-up table configured to store a plurality of classifications and a corresponding flow attribute.

18. The method of claim 14, further comprising:

generating, by the processor, one or more control signals for controlling a mixing valve, water selection valve, flow controller, electro chlorine generator ozone generator.

19. The method of claim 14, further comprising:

analyzing, by the processor, the image data to assign a cleanliness classification to the object included in the image data.

* * * * *